US010121443B2

(12) United States Patent
Konoshita

(10) Patent No.: US 10,121,443 B2
(45) Date of Patent: Nov. 6, 2018

(54) DISPLAY PANEL AND DISPLAY DEVICE

(71) Applicant: Innolux Corporation, Miao-Li County (TW)

(72) Inventor: Shinji Konoshita, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 88 days.

(21) Appl. No.: 15/430,569

(22) Filed: Feb. 13, 2017

(65) Prior Publication Data

US 2018/0233097 A1 Aug. 16, 2018

(51) Int. Cl.
*G09G 3/36* (2006.01)

(52) U.S. Cl.
CPC ..... *G09G 3/3677* (2013.01); *G09G 3/3614* (2013.01); *G09G 2300/0809* (2013.01); *G09G 2310/0291* (2013.01); *G09G 2310/08* (2013.01)

(58) Field of Classification Search
CPC .. G09G 3/3677; G09G 3/3614; G09G 3/3674; G09G 2300/0809; G09G 2310/0283; G09G 2310/0286; G09G 2310/0291; G09G 2310/08; G09G 2310/0202; G09G 2310/0205; G09G 2310/0213; G02F 1/13306; G02F 1/1333
See application file for complete search history.

(56) References Cited

U.S. PATENT DOCUMENTS

| | | | | |
|---|---|---|---|---|
| 7,679,596 | B2 | 3/2010 | Kim et al. | |
| 8,264,444 | B2 | 9/2012 | Yoshiga | |
| 8,542,178 | B2 | 9/2013 | Yoo et al. | |
| 8,736,533 | B2 | 5/2014 | Lee | |
| 9,325,311 | B1 | 4/2016 | Konoshita et al. | |
| 2004/0207593 | A1 * | 10/2004 | Ha | G09G 3/3648 345/100 |
| 2007/0091044 | A1 | 4/2007 | Park et al. | |
| 2010/0006783 | A1 * | 1/2010 | Kwon | G09G 3/3233 250/551 |
| 2010/0097368 | A1 | 4/2010 | Hwang | |
| 2010/0156947 | A1 | 6/2010 | Moon et al. | |
| 2011/0128279 | A1 * | 6/2011 | Lee | G09G 3/3648 345/212 |
| 2013/0050171 | A1 * | 2/2013 | Tsai | G09G 3/3648 345/212 |

* cited by examiner

*Primary Examiner* — Tom Sheng
(74) *Attorney, Agent, or Firm* — McClure, Qualey & Rodack, LLP

(57) ABSTRACT

A display panel includes a first gate driving circuit, a second gate driving circuit, a first pixel element and a second pixel element. The first gate driving circuit generates a first gate pulse signal. The second gate driving circuit generates a second gate pulse signal. The first gate pulse signal and the second gate pulse signal are simultaneously activated. The first pixel element receives the first gate pulse signal. The second pixel element receives the second gate pulse signal. While the first pixel element is in a negative polarity state, the second pixel element is in a positive polarity state, the first pixel element is turned off in response to a first low gate voltage of the first gate pulse signal, and the second pixel element is turned off in response to a second low gate voltage of the second gate pulse signal.

20 Claims, 17 Drawing Sheets

DISPLAY PANEL AND DISPLAY DEVICE

FIELD OF THE INVENTION

The present disclosure relates to a display panel and a display device, and more particularly to a display panel and a display device with low off current and high image quality.

BACKGROUND OF THE DISCLOSURE

FIG. 1 is a schematic circuit diagram of a conventional display panel. The display panel 10 comprises a gate driving circuit 100, a source bus 150 and plural pixel elements p11~p24.

The gate driver 110 generates a gate pulse signal Gn and Gn+1 according to a previous gate pulse signal Gn−1, Gn and a clock signal set CLK1~CLKx. The gate pulse signal Gn and Gn+1 is transmitted to the next-stage gate driver 120 and the corresponding row of pixel elements p11~p24 through the corresponding gate line. Video signals Sn−1, Sn, Sn+1, Sn+2 generated by the source driver are transmitted to the corresponding column of pixel elements p11 and p24 through the source lines of the source bus 150. Each pixel element p12~p24 comprises a switch transistor Md and a storage capacitor Cs.

The switch transistors Md are turned on in response to a high voltage level of the gate pulse signals Gn and Gn+1, and thus the corresponding pixel elements are turned on. The high voltage level is referred as a high gate voltage (VGH). Moreover, the switch transistors Md are turned off in response to a low voltage level of the gate pulse signals Gn and Gn+1, and thus the corresponding pixel elements are turned off. The low voltage level is referred as a low gate voltage (VGL).

The off current can be considered as a leakage current. The off current is proportional to the voltage difference between the gate terminal and the source terminal of the switch transistors Md (i.e., a gate-source voltage Vgs). As the gate-source voltage Vgs increases, the off current increases. The increase of the off current may result in deteriorated image quality and flickering frame of the display panel and cause higher power consumption of the source driver.

SUMMARY OF THE INVENTION

An embodiment of the present disclosure provides a display panel. The display panel includes a first gate driving circuit, a second gate driving circuit and a first pixel element row. The first gate driving circuit generates a first gate pulse signal. The second gate driving circuit generates a second gate pulse signal. The first gate pulse signal and the second gate pulse signal are simultaneously activated. The first pixel element row includes a first pixel element and a second pixel element. The first pixel element receives the first gate pulse signal. The second pixel element receives the second gate pulse signal. While the first pixel element is in a negative polarity state, the second pixel element is in a positive polarity state, the first pixel element is turned off in response to a first low gate voltage of the first gate pulse signal, and the second pixel element is turned off in response to a second low gate voltage of the second gate pulse signal. While the first pixel element is in the positive polarity state, the second pixel element is in the negative polarity state, the first pixel element is turned off in response to a second low gate voltage of the first gate pulse signal, the second pixel element is turned off in response to a first low gate voltage of the second gate pulse signal, the first low gate voltage of the first gate pulse signal is less than the second low gate voltage of the first gate pulse signal, and the first low gate voltage of the second gate pulse signal is less than the second low gate voltage of the second gate pulse signal.

Another embodiment of the present invention provides a display panel. The display panel includes a first gate driving circuit, a second gate driving circuit, a first pixel element row and a second pixel element row. The first gate driving circuit generates a first gate pulse signal. The second gate driving circuit generates a second gate pulse signal. The first pixel element row receives the first gate pulse signal. The second pixel element row receives the second gate pulse signal. While plural pixel elements of the first pixel element row are in a negative polarity state, plural pixel elements of the second pixel element row are in a positive polarity state, the plural pixel elements of the first pixel element row are turned off in response to a first low gate voltage of the first gate pulse signal, and the plural pixel elements of the second pixel element row are turned off in response to a second low gate voltage of the second gate pulse signal. While the plural pixel elements of the first pixel element row are in the positive polarity state, the plural pixel elements of the second pixel element row are in the negative polarity state, the plural pixel elements of the first pixel element row are turned off in response to a second low gate voltage of the first gate pulse signal, the plural pixel elements of the second pixel element row are turned off in response to a first low gate voltage of the second gate pulse signal, the first low gate voltage of the first gate pulse signal is less than the second low gate voltage of the first gate pulse signal, and the first low gate voltage of the second gate pulse signal is less than the second low gate voltage of the second gate pulse signal.

A further embodiment of the present invention provides a display device. The display device includes a driving control unit and a display panel. A first gate driving circuit of the display panel generating a first gate pulse signal, and a second gate driving circuit of the display panel generating a second gate pulse signal, wherein the first gate pulse signal and the second gate pulse signal are simultaneously activated. A first pixel element row of the display panel comprising a first pixel element and a second pixel element, wherein the first pixel element receives the first gate pulse signal, and the second pixel element receives the second gate pulse signal. While the first pixel element is in a negative polarity state, the second pixel element is in a positive polarity state, the first pixel element is turned off in response to a first low gate voltage of the first gate pulse signal, and the second pixel element is turned off in response to a second low gate voltage of the second gate pulse signal, wherein while the first pixel element is in the positive polarity state, the second pixel element is in the negative polarity state, the first pixel element is turned off in response to a second low gate voltage of the first gate pulse signal, and the second pixel element is turned off in response to a first low gate voltage of the second gate pulse signal, the first low gate voltage of the first gate pulse signal is less than the second low gate voltage of the first gate pulse signal, and the first low gate voltage of the second gate pulse signal is less than the second low gate voltage of the second gate pulse signal.

Numerous objects, features and advantages of the present disclosure will be readily apparent upon a reading of the following detailed description of embodiments of the present disclosure when taken in conjunction with the accompanying drawings. However, the drawings employed herein are for the purpose of descriptions and should not be regarded as limiting.

BRIEF DESCRIPTION OF THE DRAWINGS

The above objects and advantages of the present disclosure will become more readily apparent to those ordinarily skilled in the art after reviewing the following detailed description and accompanying drawings, in which.

DETAILED DESCRIPTION OF PREFERRED EMBODIMENTS

The present disclosure provides a display panel of a display device. The gate driver of the display panel provides different low gate voltages according to the state of the pixel element. For example, when the pixel element is in a negative polarity state, the gate driver provides a first low gate voltage VGL1. When the pixel element is in a positive polarity state, the gate driver provides a second low gate voltage VGL2. Also, the first low gate voltage VGL1 is less than the second low gate voltage VGL2. In the embodiment, the display panel is a liquid crystal display (LCD) panel, and a liquid crystal display (LCD) device comprises a LCD panel, a backlight unit (not shown) and a driving control unit (not shown). In other embodiment, the display panel is a light emitting diode (LED or OLED) display panel, and a light emitting diode (LED or OLED) display device comprises a LED display panel (or OLED display panel) and a driving control unit (not shown).

Figure 1:
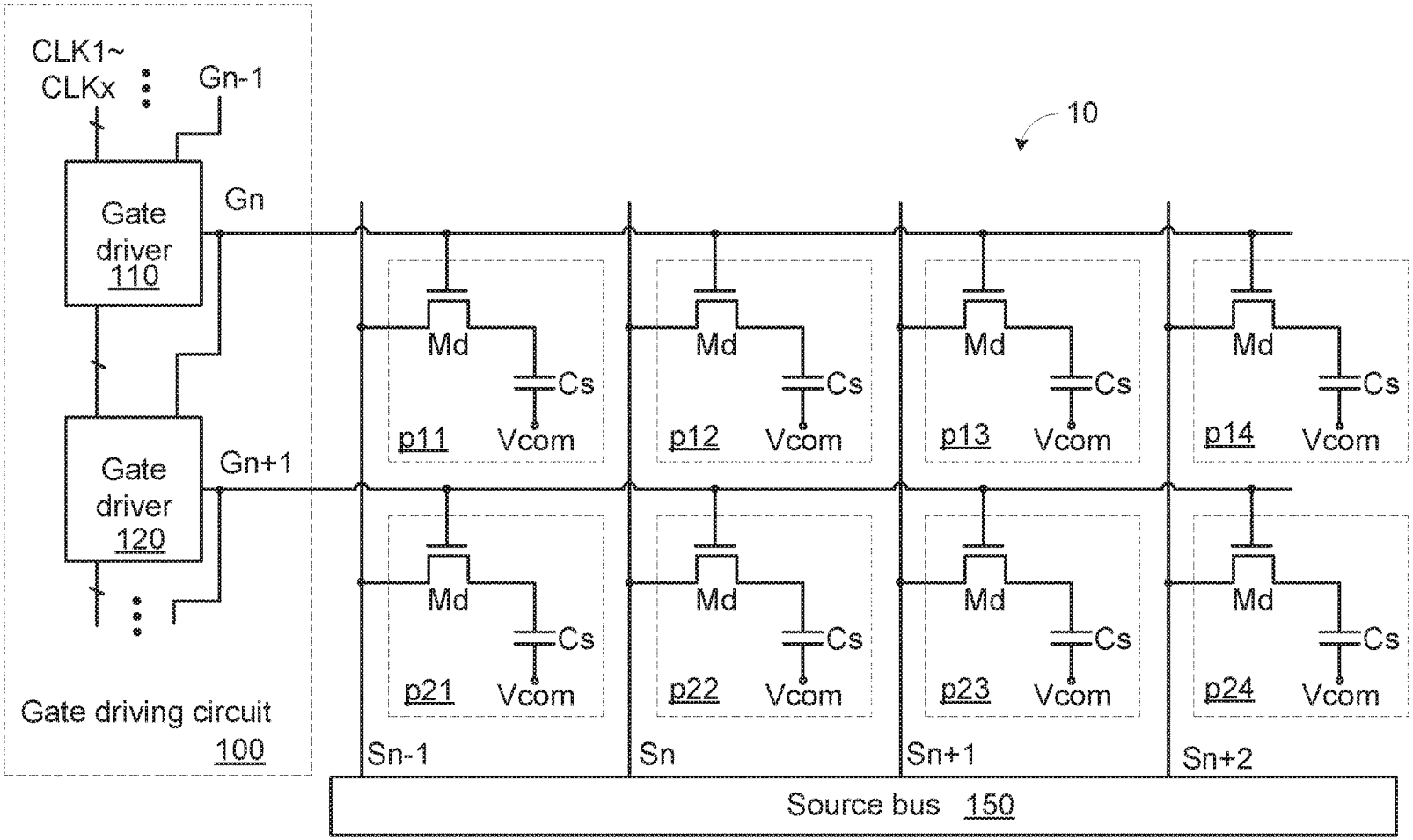
FIG. 1 (PRIOR ART)
FIG. 1 (prior art) is a schematic circuit diagram of a conventional display panel.
Figure 2A:
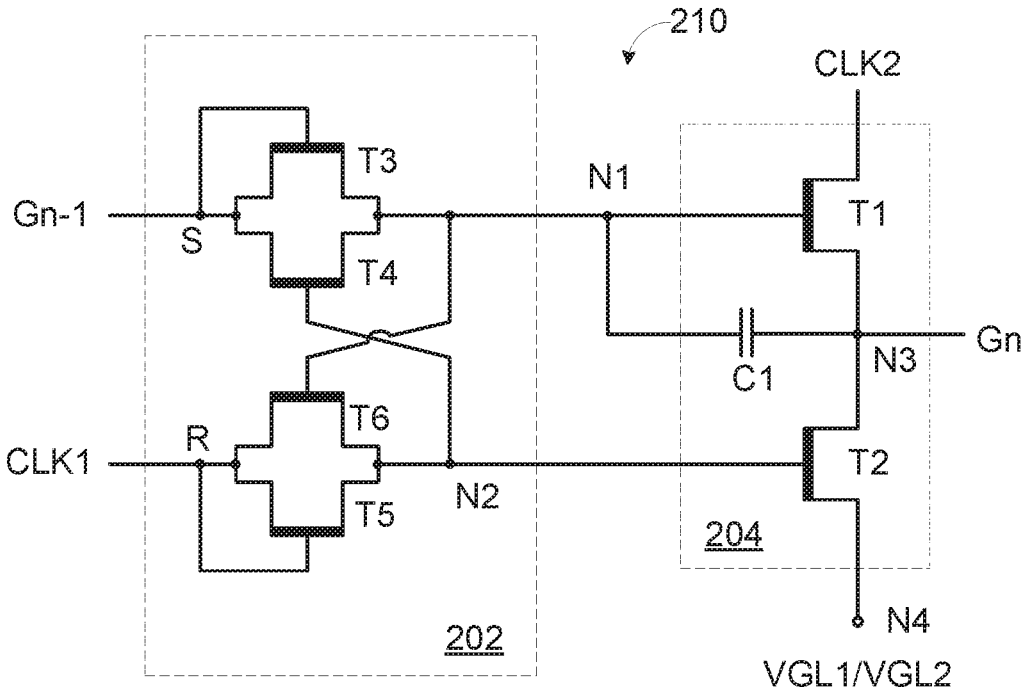
FIG. 2A is a schematic circuit diagram illustrating a gate driver used in a display panel of the present disclosure.

FIG. 2A is a schematic circuit diagram u rating a Gn stage gate driver used in a display panel of the present disclosure. As shown in FIG. 2A, the gate driver 210 comprises a latch circuit 202 and an output circuit 204. The latch circuit 202 receives a clock signal CLK1 and a gate pulse signal Gn−1 from a previous-stage gate driver. The output circuit 204 is connected to the latch circuit 202. Moreover, the output circuit 204 generates a gate pulse signal Gn. The low voltage level of the gate pulse signal Gn is selectively a first low gate voltage VGL1 or a second low gate voltage VGL2. The operating principles will be illustrated in more details as follows.

The latch circuit 202 comprises four transistors T3, 14, T5 and T6. The drain terminal and the gate terminal of the transistor T3 are connected to a node S to receive the gate pulse signal Gn−1 from the previous-stage gate driver. The source terminal of the transistor T3 is connected to a node N1. The drain terminal of the transistor T4 is connected to the node S to receive the gate pulse signal Gn−1 from the previous-stage gate driver. The gate terminal of the transistor T4 is connected to a node N2. The source terminal of the transistor T4 is connected to the node N1. The drain terminal and the gate terminal of the transistor T5 are connected to a node R to receive the clock signal CLK1. The source terminal of the transistor T5 is connected to the node N2. The drain terminal of the transistor T6 is connected to the R to receive the clock signal CLK1. The gate terminal of the transistor T6 is connected to the node N1. The source terminal of the transistor T6 is connected to the node N2. In this embodiment, the latch circuit 202 is a SR latch. The node S is a set terminal of the latch circuit 202. The node R is a reset terminal of the latch circuit 202.

The output circuit 204 comprises a capacitor C1 and two transistors T1 and T2. The drain terminal of the transistor T1 receives a clock signal CLK2. The gate terminal of the transistor T1 is connected to the node N1. The source terminal of the transistor T1 is connected to a node N3. The two terminals of the capacitor C1 is connected to the node N1 and the node N3 respectively. The drain terminal of the transistor T2 is connected to the node N3. The gate terminal of the transistor T2 is connected to the node N2. The source terminal of the transistor T2 is connected to a node N4. The voltage at the node N3 is correlated with the gate pulse signal Gn that is outputted from the gate driver 210.

In an embodiment, the node N4 is connected to a low gate voltage generator (not shown). The low gate voltage generator provides one of two low gate voltages VGL1 and VGL2 to the node N4, and the first low gate voltage VGL1 is less than the second low gate voltage VGL2. When the pixel element is in the negative polarity state, the node N4 receives the first low gate voltage VGL1. When the pixel element is in the positive polarity state, the node N4 receives the second low gate voltage VGL2.

Figure 2B:
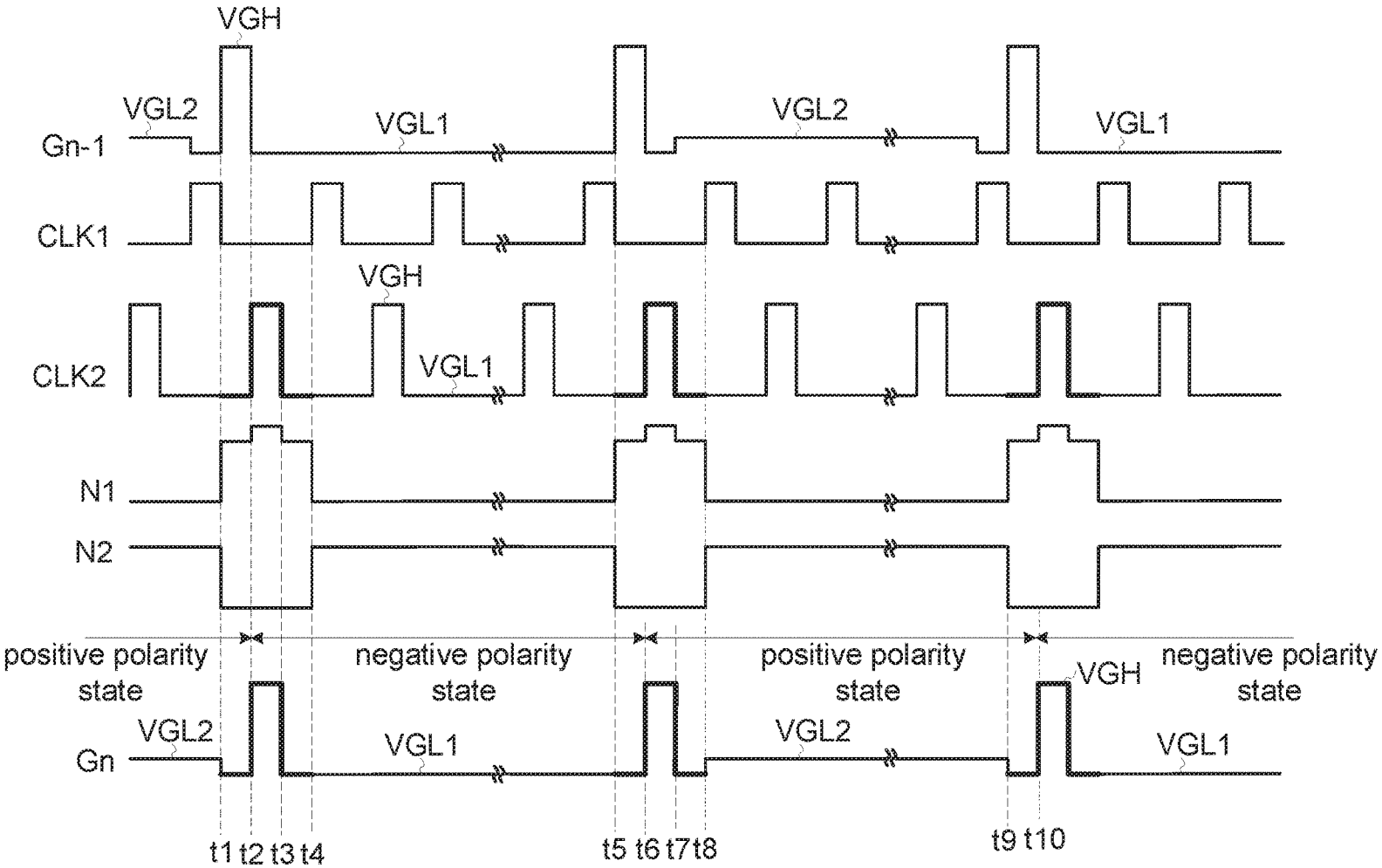
FIGS. 2B and 2C are schematic timing waveform diagrams illustrating associated signals processed by the gate driver of FIG. 2A.

FIG. 2B is a schematic timing waveform diagram illustrating an example of the associated signals processed by the gate driver. As shown in FIG. 2B, the phase of the clock signal CLK1 leads the phase of the clock signal CLK2 by 180 degrees. Moreover, the clock signal CLK2 has a high gate voltage VGH in a high voltage level, and the clock signal CLK2 has the first low gate voltage VGL1 in a low voltage level. The first low gate voltage VGL1 and the second low gate voltage VGL2 for the gate driver are respectively −7.5V and −2.5V, but are not limited thereto.

Whenever a frame of the display panel is changed, the state of the pixel elements which are connected to gate driver is corresponding changed. As shown in FIG. 2B, the pixel elements are in the negative polarity state during the time interval of showing a frame between the time point t2 and the time point t6, and the pixel elements are in the positive polarity state during the time interval of showing a next frame between the time point t6 and the time point t10.

Please refer to FIG. 2B. Before the time point t1, the previous gate pulse signal Gn−1 is the low voltage level and the clock signal CLK1 is the high voltage level. Meanwhile, the latch circuit 202 is in a reset state, the node N is the low voltage level, and the node N2 is the high voltage level. Consequently, the transistor T1 of the output circuit 204 is turned off, and the transistor T2 of the output circuit 204 is turned on. Under this circumstance, the second low gate voltage VGL2 received by the node N4 is outputted from the output circuit 204 and used as the gate pulse signal Gn.

In the time interval between the time point t1 and the time interval t2, the previous gate pulse signal Gn−1 is the high voltage level and the clock signal CLK1 is the low voltage level. Meanwhile, the latch circuit 202 is in a set state, the node N1 is the high voltage level, and the node N2 is the low voltage level. Consequently, the transistor T1 of the output circuit 204 is turned on, and the transistor T2 of the output circuit 204 is turned off. Under this circumstance, the first low gate voltage VGL1 of the clock signal CLK2 is outputted from the output circuit 204 and used as the gate pulse signal Gn.

In the time interval between the time point t2 and the time interval t3, the latch circuit 202 is maintained in the set state. According to the clock signal CLK2, the voltage of the node N1 is boosted to a higher voltage level by the capacitor C1 Consequently, the transistor T1 of the output circuit 204 is turned on, and the transistor T2 of the output circuit 204 is turned off. Under this circumstance, the high gate voltage UGH of the clock signal CLK2 is outputted from the output circuit 204 and used as the gate pulse signal Gn.

In the time interval between the time point t3 and the time interval t4, the latch circuit 202 is maintained in the set state. Consequently, the transistor T1 of the output circuit 204 is turned on, and the transistor T2 of the output circuit 204 is turned off. Under this circumstance, the first low gate voltage VGL1 of the dock signal CLK2 is outputted from the output circuit 204 and used as the gate pulse signal Gn.

In the time interval between the time point t4 and the time interval t5, the previous gate pulse signal Gn−1 is the low voltage level and the clock signal CLK1 is switched between the high voltage level and the low voltage level. Meanwhile, the latch circuit 202 is in a reset state, the node N1 is the low voltage level, and the node N2 is the high voltage level. Consequently, the transistor T1 of the output circuit 204 is turned off, and the transistor T2 of the output circuit 204 is turned on. Under this circumstance, the first low gate voltage VGL1 received by the node N4 is outputted from the output circuit 204 and used as the gate pulse signal Gn.

The waveform of the gate pulse signal Gn in the time interval between the time point t5 and the time point t8 is similar to the waveform of the gate pulse signal Gn in the time interval between the time point t1 and the time point t4, and is not redundantly described herein.

In the time interval between the time point t8 and the time interval t9, the previous gate pulse signal Gn−1 is the low voltage level and the clock signal CLK1 is switched between the high voltage level and the low voltage level. Meanwhile, the latch circuit 202 is in the reset state, the node N1 is the low voltage level, and the node N2 is the high voltage level. Consequently, the transistor T1 of the output circuit 204 is turned off, and the transistor T2 of the output circuit 204 is turned on. Under this circumstance, the second low gate voltage VGL2 received by the node N4 is outputted from the output circuit 204 and used as the gate pulse signal Gn.

According to the waveform of FIG. 2B, when the latch circuit 202 is in the set state, the clock signal CLK2 is outputted from the output circuit 204 and used as the gate pulse signal Gn. When the latch circuit 202 is in the reset state and the pixel element is in the negative polarity state, the first low gate voltage VGL1 is outputted from the output circuit 204 and used as the gate pulse signal Gn. When the latch circuit 202 is in the reset state and the pixel element is in the positive polarity state, the second low gate voltage VGL2 is outputted from the output circuit 204 and used as the gate pulse signal Gn.

In the time interval between the time point t2 and the time point t6, the pixel element is in the negative polarity state and one frame is displayed on the display panel. In the time interval between the time point t2 and the time point t3, the gate pulse signal Gn has the high gate voltage VGH, and thus the switching transistor Md of the pixel element is turned on. In the time interval between the time point t3 and the time point t6, the gate pulse signal Gn has the first low gate voltage VGL1, and thus the switching transistor Md of the pixel element is turned off.

In the time interval between the time point t6 and the time point t9, the pixel element is in the positive polarity state and another frame is displayed on the display panel. In the time interval between the time point t6 and the time point t7, the gate pulse signal Gn has the high gate voltage VGH, and thus the switching transistor Md of the pixel element is turned on. In the time interval between the time point t7 and the time point t10, a greater portion of the gate pulse signal Gn has the second low gate voltage VGL2, and thus the switching transistor Md of the pixel element is turned off.

As mentioned above, a minority of the gate pulse signal Gn has the first low gate voltage VGL1 and majority of the gate pulse signal Gn has the second low gate voltage VGL2 when the pixel element is in the positive polarity state. By modifying the waveform of the clock signal CLK2, the above problem can be overcome.

Figure 2C:
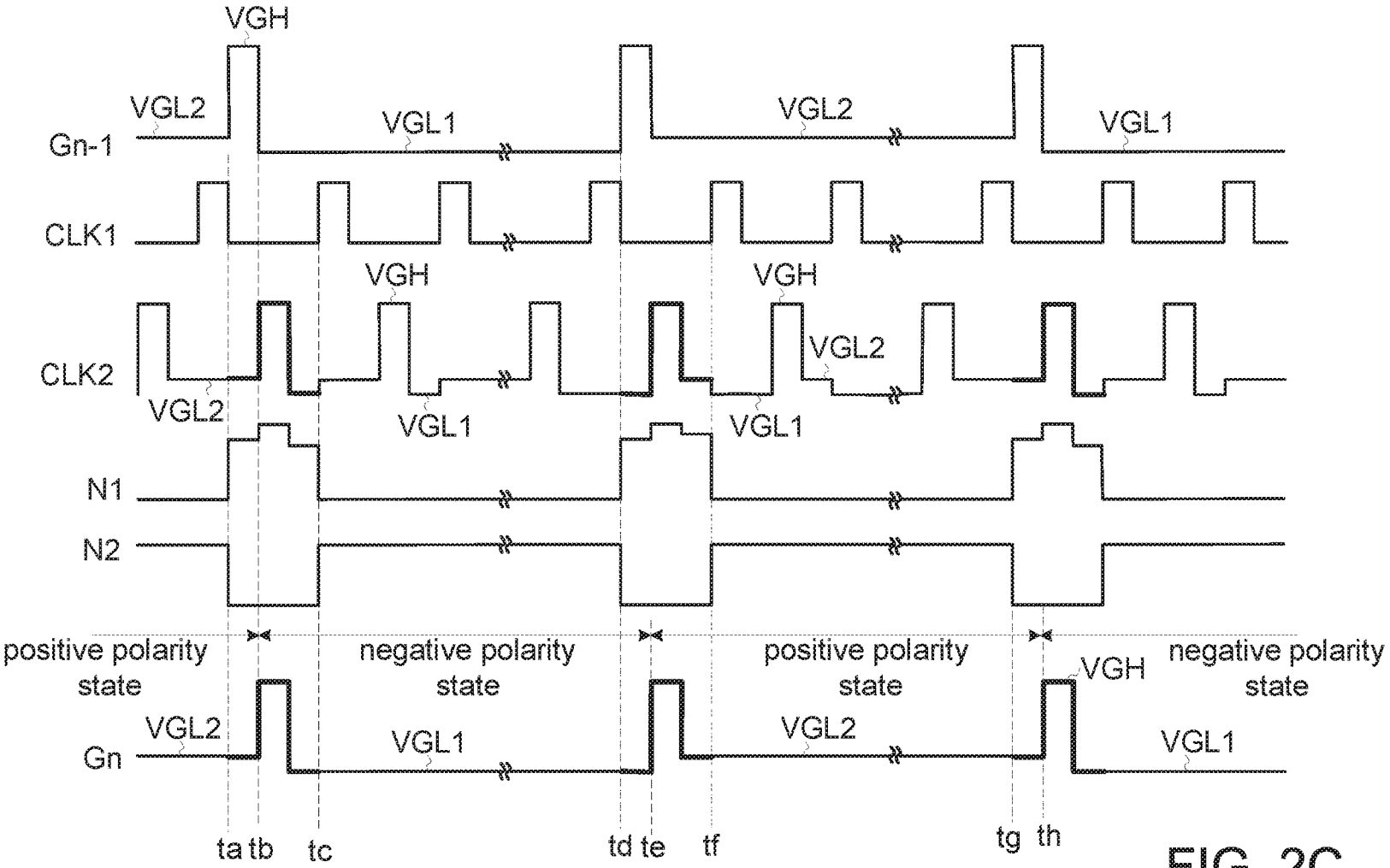

FIG. 2C is a schematic timing waveform diagram illustrating another example of the associated signals processed by the gate driver. In comparison with FIG. 2B, the clock signal CLK2 is distinguished. In case that the pixel element is in the negative polarity state, the voltage level of the clock signal CLK2 is maintained in the first low gate voltage VGL1 for a short time after the falling edge of the clock signal CLK2 from the high gate voltage VGH, and then the voltage level of the clock signal CLK2 is restored to the second low gate voltage VGL2. In case that the pixel element is in the positive polarity state, the voltage level of the clock signal CLK2 is maintained in the second low gate voltage VGL2 for a short time after the falling edge of the clock signal CLK2 from the high gate voltage VGH, and then the voltage level of the clock signal CLK2 is restored to the first low gate voltage VGL1.

Please refer to FIG. 2C. In the time interval between the time point to and the time point tc, the latch circuit 202 is in a set state. Meanwhile, the clock signal CLK2 is outputted from the output circuit 204 arid used as the gate pulse signal Gn. Similarly, in the time interval between the time point td and the time point tf, the latch circuit 202 is in a set state. Meanwhile, the clock signal CLK2 is outputted from the output circuit 204 and used as the gate pulse signal Gn.

In the time interval between the time point tb arid the time point te, the pixel element is in the negative polarity state and one frame is displayed on the display panel. The gate pulse signal Gn has a high gate voltage VGH in a high voltage level, and the gate pulse signal Gn has the first low gate voltage VGL1 in a low voltage level. In the time interval between the time point to and the time point th, the pixel element is in the positive polarity state and another frame is displayed on the display panel. The gate pulse signal Gn has a high gate voltage VGH in a high voltage level, and the gate pulse signal Gn has the second low gate voltage VGL2 in a low voltage level.

Figure 3A:
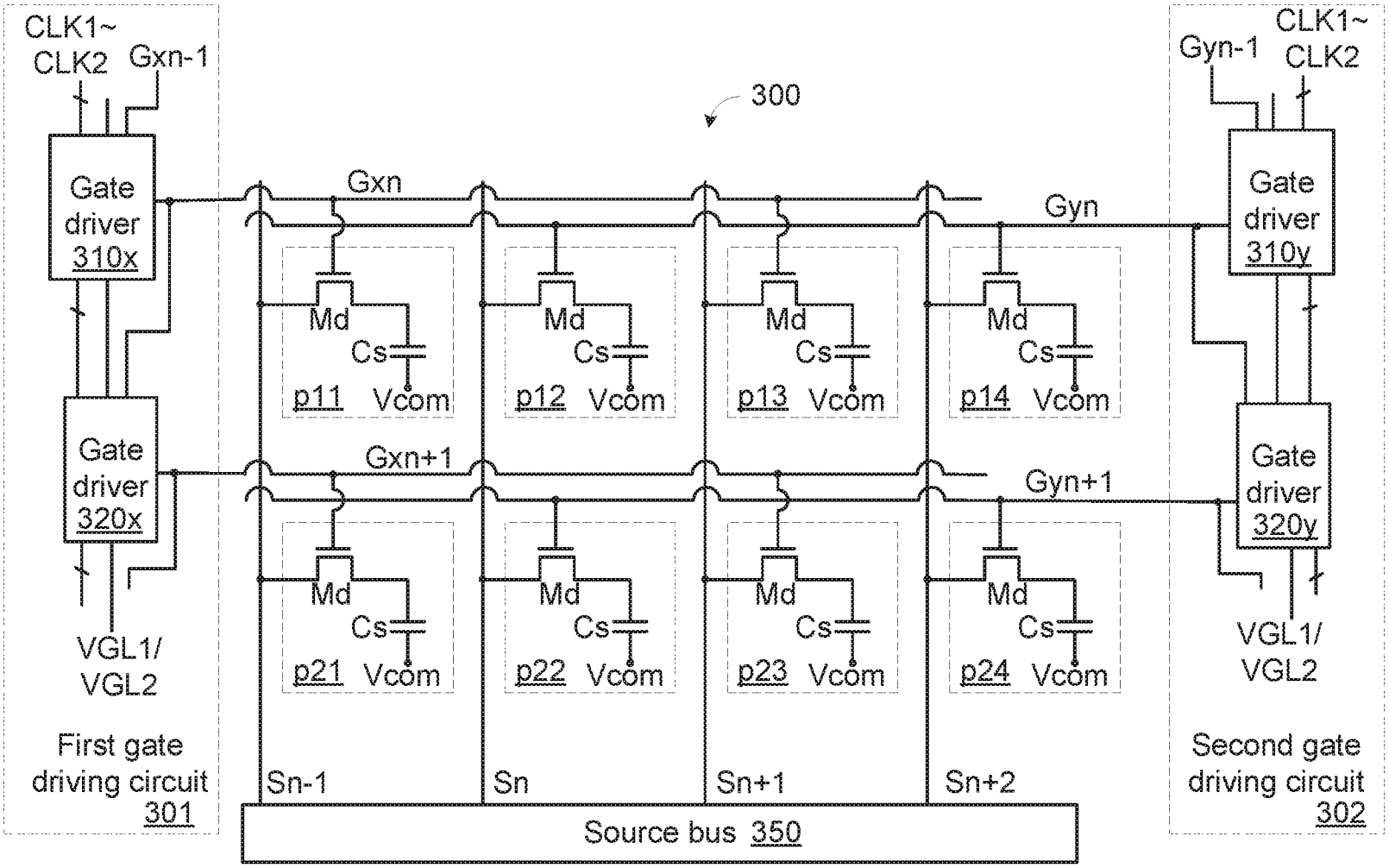
FIG. 3A is a schematic circuit diagram illustrating a display panel according to a first embodiment of the present disclosure.

The present disclosure further provides a display panel with polarity inversion scheme. The gate driver having the above characteristics is applied to the display panel. FIG. 3A is a schematic circuit diagram illustrating a display panel according to a first embodiment of the present disclosure. As shown in FIG. 3A, the display panel 300 comprises a first gate driving circuit 301, a second gate driving circuit 302, a source bus 350 and plural pixel elements p11~p24. The plural pixel elements p11~p24 are arranged in a 2×4 pixel array. It is noted that the number of the pixel elements and the arrangement of the pixel array are not restricted. In this embodiment, the display panel 300 is operated in column inversion. In the embodiment, the first gate driving circuit 301 and the second gate driving circuit 302 are disposed at two opposite sides of the display panel 300. In other embodiment, the first gate driving circuit 301 and the second gate driving circuit 302 could be disposed at the same side of the display panel 300.

The first gate driving circuit 301 comprises plural serially-connected gate drives. For clarification, only two gate drivers 310*x* and 320*x* of the first gate driving circuit 301 are shown. The second gate driving circuit 302 comprises plural serially-connected gate drives. For clarification, only two gate drivers 310*y* and 320*y* of the second gate driving circuit 302 are shown. Moreover, a first portion of the pixel elements in the same row are connected to the first gate driving circuit 301, and a second portion of the pixel elements in the same row are connected to the second gate driving circuit 302.

The connecting relations of the pixels p11~p14 in the first row will be described as follows. The odd-numbered pixel elements p11 and p13 are connected to the gate driver 310*x* of the first gate driving circuit 301. The even-numbered pixel elements p12 and p14 are connected to the gate driver 310*y* of the second gate driving circuit 302. The gate pulse signal Gxn from the gate driver 310*x* and the gate pulse signal Gyn from the gate driver 310*y* are simultaneously activated.

The connecting relations of the pixels p21~p24 in the second row will be described as follows. The odd-numbered pixel elements p21 and p23 are connected to the gate driver 320*x* of the first gate driving circuit 301. The even-numbered pixel elements p22 and p24 are connected to the gate driver 320*y* of the second gate driving circuit 302. The gate pulse signal Gxn+1 from the gate driver 320*x* and the gate pulse signal Gyn+1 from the gate driver 320*y* are simultaneously activated.

The source bus 350 comprises plural source lines, and the plural source lines are connected to the corresponding columns of pixel elements. As shown in FIG. 3A, the source bus 350 comprises four source lines. The pixel elements p11 and p21 are connected to the first source line for receiving a video signal Sn−1. The pixel elements p12 and p22 are connected to the second source line for receiving a video signal Sn. The pixel elements p13 and p23 are connected to the third source line for receiving a video signal Sn+1. The pixel elements p14 and p24 are connected to the fourth source line for receiving a video signal Sn+2.

Figure 3B:
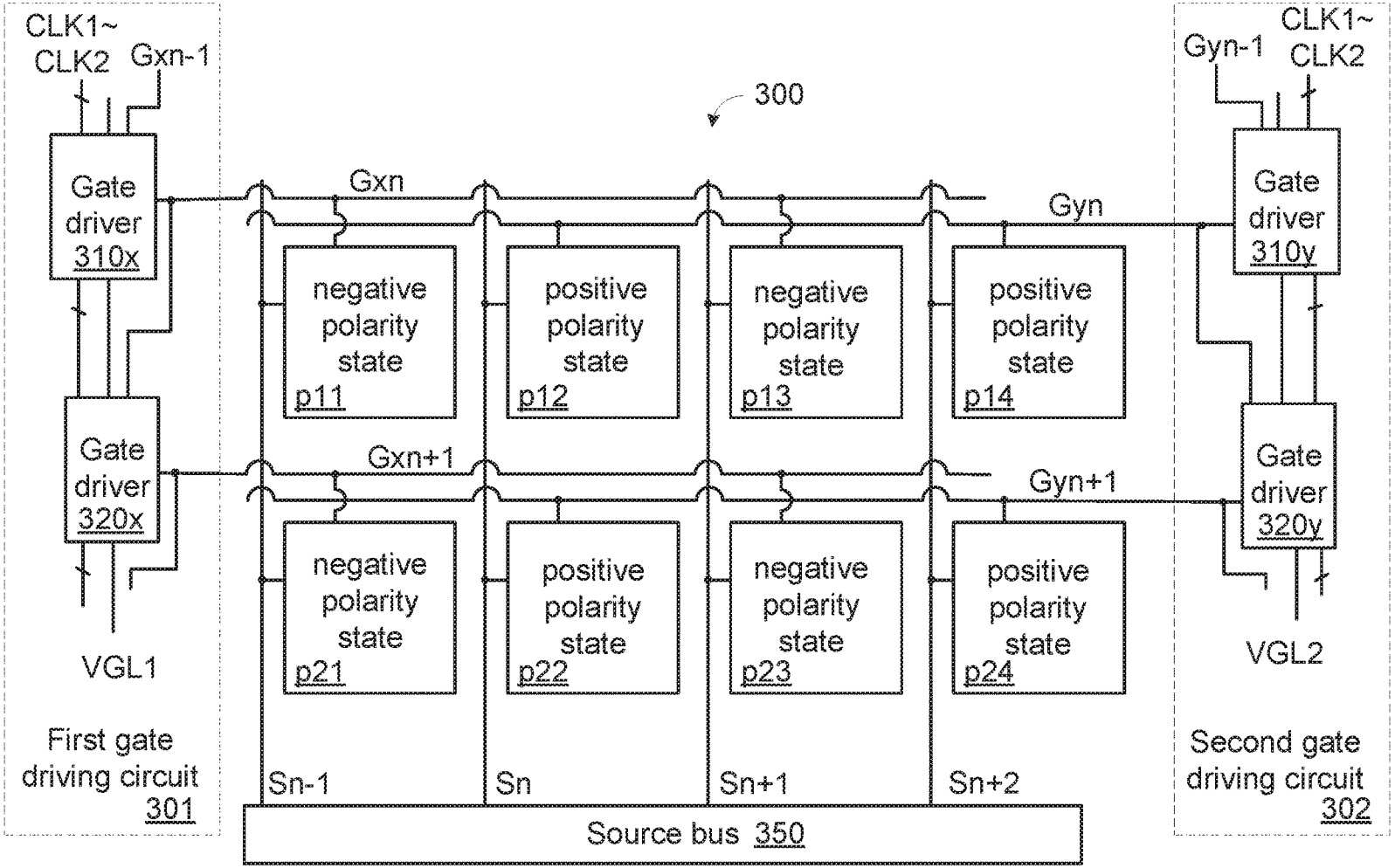
FIGS. 3B and 3C schematically illustrate the operation of the display panel according to the first embodiment of the present disclosure.

The operation of the display panel according to the first embodiment will be described with reference to FIGS. 3B and 3C. FIG. 3B schematically illustrates the operation of the display panel according to the first embodiment when a first frame is displayed. The video signals Sn−1 and Sn+1 have a first polarity (e.g., a negative polarity). The video signals Sn and Sn+2 have a second polarity (e.g., a positive polarity). The first gate driving circuit 301 receives a first low gate voltage VGL1, a clock signal CLK1 and a clock signal CLK2. The second gate driving circuit 302 receives a second low gate voltage VGL2, the clock signal CLK1 and the clock signal CLK2. The clock signal CLK2 has the waveform of FIG. 2B or the waveform of FIG. 2C.

When the gate pulse signal Gxn from the gate driver 310*x* and the gate pulse signal Gyn from the gate driver 310*y* are simultaneously activated, the pixel elements p11~p14 are simultaneously turned on. Since the pixel elements p11 and p13 receive the video signals Sn−1 and Sn+1 having the first polarity, the pixel elements p11 and p13 are in a negative polarity state. Since the pixel elements p12 and p14 receive the video signals Sn and Sn+2 having the second polarity, the pixel elements p12 and p14 are in a positive polarity state. Then, the pixel elements p11 and p13 are turned off in response to the first low gate voltage VGL1 of the gate pulse signal Gxn from the gate driver 310*x*, and the pixel elements p12 and p14 are turned off in response to the second low gate voltage VGL2 of the gate pulse signal Gyn from the gate driver 310*y*.

The gate pulse signals Gxn+1 and Gyn+1 are simultaneously activated by the gate drivers 320*x* and 320*y* according to the gate pulse signals Gxn and Gyn. When the gate pulse signal Gxn+1 and the gate pulse signal Gyn+1 are simultaneously activated, the pixel elements p21~p24 are simultaneously turned on. Since the pixel elements p21 and p23 receive the video signals Sn−1 and Sn+1 having the first polarity, the pixel elements p21 and p23 are in the negative polarity state. Since the pixel elements p22 and p24 receive the video signals Sn and Sn+2 having the second polarity, the pixel elements p22 and p24 are in the positive polarity state. Then, the pixel elements p21 and p23 are turned off in response to the first low gate voltage VGL1 of the gate pulse signal Gxn+1 from the gate driver 320*x*, and the pixel elements p22 and p24 are turned off in response to the second low gate voltage VGL2 of the gate pulse signal Gyn+1 from the gate driver 320*y*.

Figure 3C:
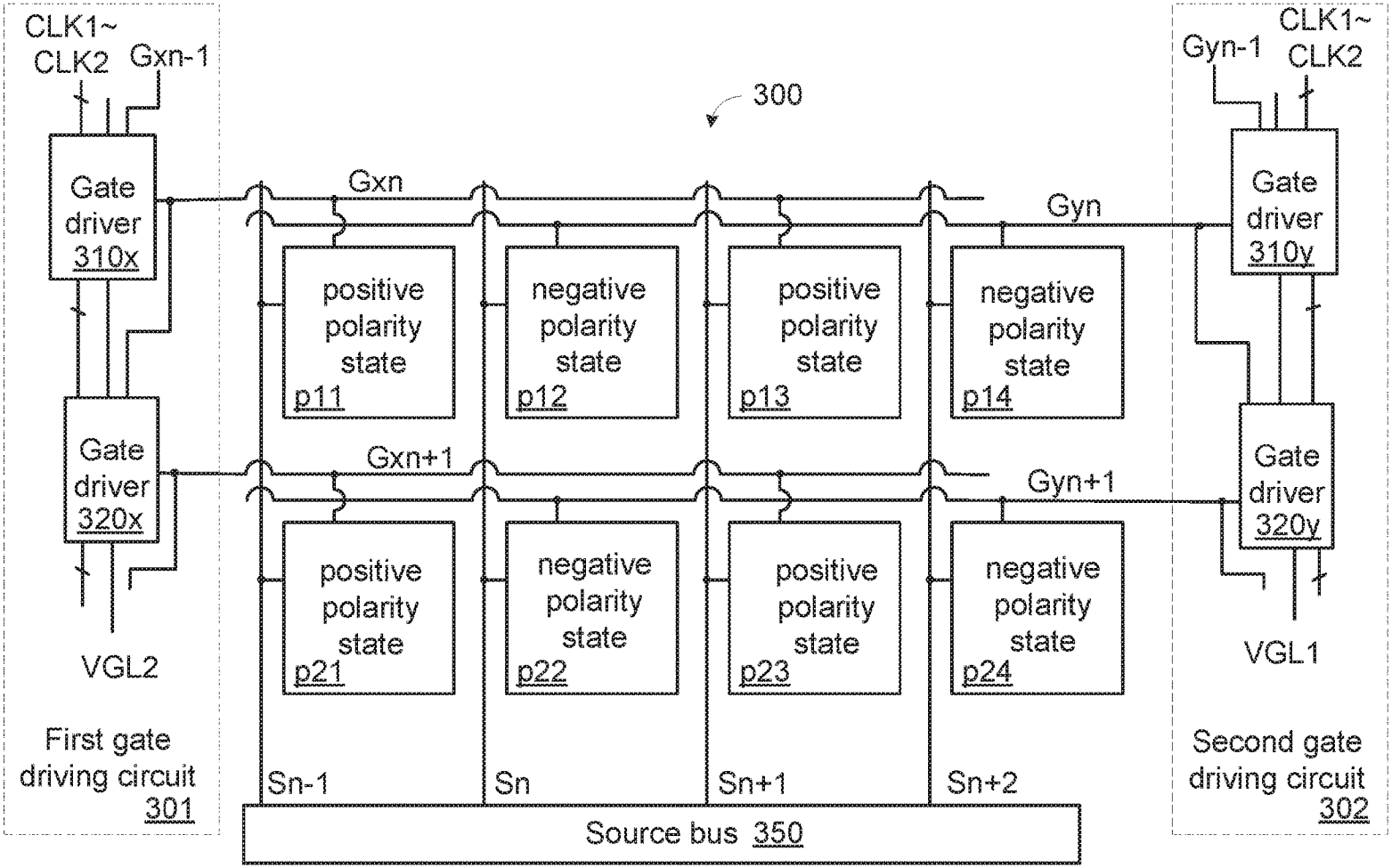

FIG. 3C schematically illustrates the operation of the display panel according to the first embodiment when a second frame is displayed. The video signals Sn−1 and Sn+1 have the second polarity (e.g., the positive polarity). The video signals Sn and Sn+2 have the first polarity (e.g., the negative polarity). The first gate driving circuit 301 receives the second low gate voltage VGL2, the clock signal CLK1 and the clock signal CLK2. The second gate driving circuit 302 receives the first low gate voltage VGL1, the clock signal CLK1 and the clock signal CLK2.

When the gate pulse signal Gxn from the gate driver 310*x* and the gate pulse signal Gyn from the gate driver 310*y* are simultaneously activated, the pixel elements p11~p14 are simultaneously turned on. Since the pixel elements p11 and p13 receive the video signals Sn−1 and Sn+1 having the second polarity, the pixel elements p11 and p13 are in the positive polarity state. Since the pixel elements p12 and p14 receive the video signals Sn and Sn+2 having the first polarity, the pixel elements p12 and p14 are in the negative polarity state. Then, the pixel elements p11 and p13 are turned off in response to the second low gate voltage VGL2 of the gate pulse signal Gxn from the gate driver 310*x*, and the pixel elements p12 and p14 are turned off in response to the first low gate voltage VGL1 of the gate pulse signal Gyn from the gate driver 310*y*.

The gate pulse signals Gxn+1 and Gyn+1 are simultaneously activated by the gate drivers 320*x* and 320*y* according to the gate pulse signals Gxn and Gyn. When the gate pulse signal Gxn+1 and the gate pulse signal Gyn+1 are simultaneously activated, the pixel elements p21~p24 are simultaneously turned on. Since the pixel elements p21 and p23 receive the video signals Sn−1 and Sn+1 having the second polarity, the pixel elements p21 and p23 are in the positive polarity state. Since the pixel elements p22 and p24 receive the video signals Sn and Sn+2 having the first polarity, the pixel elements p22 and p24 are in the negative polarity state. Then, the pixel elements p21 and p23 are turned off in response to the second low gate voltage VGL2 of the gate pulse signal Gxn+1 from the gate driver 320*x*, and the pixel elements p22 and p24 are turned off in response to the first low gate voltage VGL1 of the gate pulse signal Gyn+1 from the gate driver 320*y*.

Figure 4A:
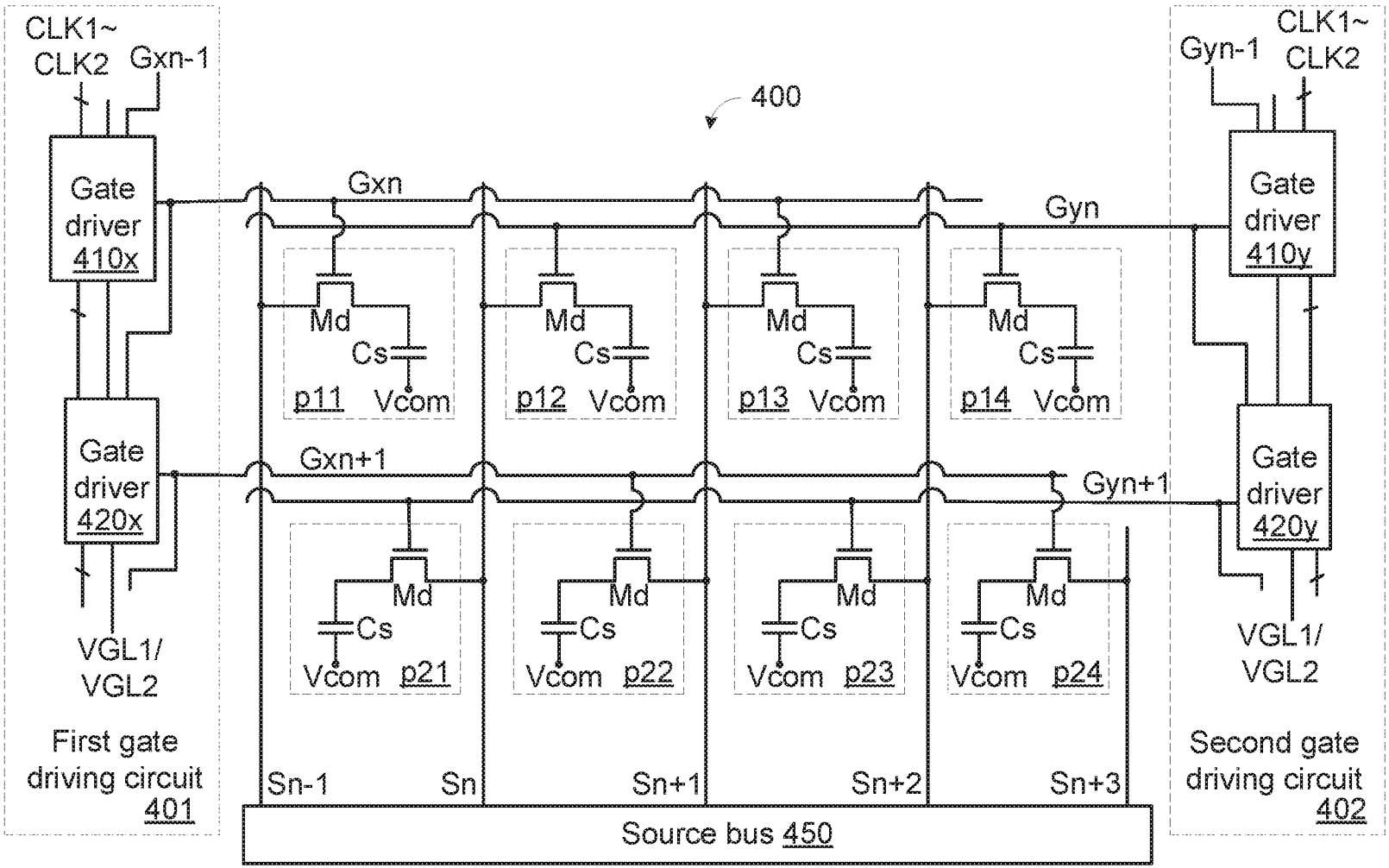
FIG. 4A is a schematic circuit diagram illustrating a display panel according to a second embodiment of the present disclosure.

FIG. 4A is a schematic circuit diagram illustrating a display panel according to a second embodiment of the present disclosure. As shown in FIG. 4A, the display panel 400 comprises a first gate driving circuit 401, a second gate driving circuit 402, a source bus 450 and plural pixel elements p11~p24. The plural pixel elements p11~p24 are arranged in a 2×4 pixel array. It is noted that the number of the pixel elements and the arrangement of the pixel array are not restricted. In this embodiment, the display panel 400 is operated in pseudo-dot inversion. In the embodiment, the first gate driving circuit 401 and the second gate driving circuit 402 are disposed at two opposite sides of the display panel 400. In other embodiment, the first gate driving circuit 401 and the second gate driving circuit 402 could be disposed at the same side of the display panel 400.

The first gate driving circuit 401 comprises plural serially-connected gate drives. For clarification, only two gate drivers 410*x* and 420*x* of the first gate driving circuit 401 are shown. The second gate driving circuit 402 comprises plural serially-connected gate drives. For clarification, only two gate drivers 410*y* and 420*y* of the second gate driving circuit 402 are shown. Moreover, a first portion of the pixel elements in the same row are connected to the first gate driving circuit 401, and a second portion of the pixel elements in the same row are connected to the second gate driving circuit 402.

The connecting relations of the pixels p11~p14 in the first row will be described as follows. The odd-numbered pixel elements p11 and p13 are connected to the gate driver 410*x* of the first gate driving circuit 401. The even-numbered pixel elements p12 and p14 are connected to the gate driver 410*y* of the second gate driving circuit 402. The gate pulse signal Gxn from the gate driver 410*x* and the gate pulse signal Gyn from the gate driver 410*y* are simultaneously activated.

The connecting relations of the pixels p21~p24 in the second row will be described as follows. The odd-numbered pixel elements p21 and p23 are connected to the gate driver 420*y* of the second gate driving circuit 402. The even-numbered pixel elements p22 and p24 are connected to the gate driver 420*x* of the first gate driving circuit 401. The gate pulse signal Gxn+1 from the gate driver 420*x* and the gate pulse signal Gyn+1 from the gate driver 420*y* are simultaneously activated.

The source bus 450 comprises plural source lines, and the plural source lines are connected to the corresponding columns of pixel elements. As shown in FIG. 4A, the source bus 450 comprises five source lines. The pixel element p11 is connected to the first source line for receiving a video signal Sn−1. The pixel elements p12 and p21 are connected to the second source line for receiving a video signal Sn. The pixel elements p13 and p22 are connected to the third source line for receiving a video signal Sn+1. The pixel elements p14 and p23 are connected to the fourth source line for receiving a video signal Sn+2. The pixel element p24 is connected to the fifth source line for receiving a video signal Sn+3.

Figure 4B:
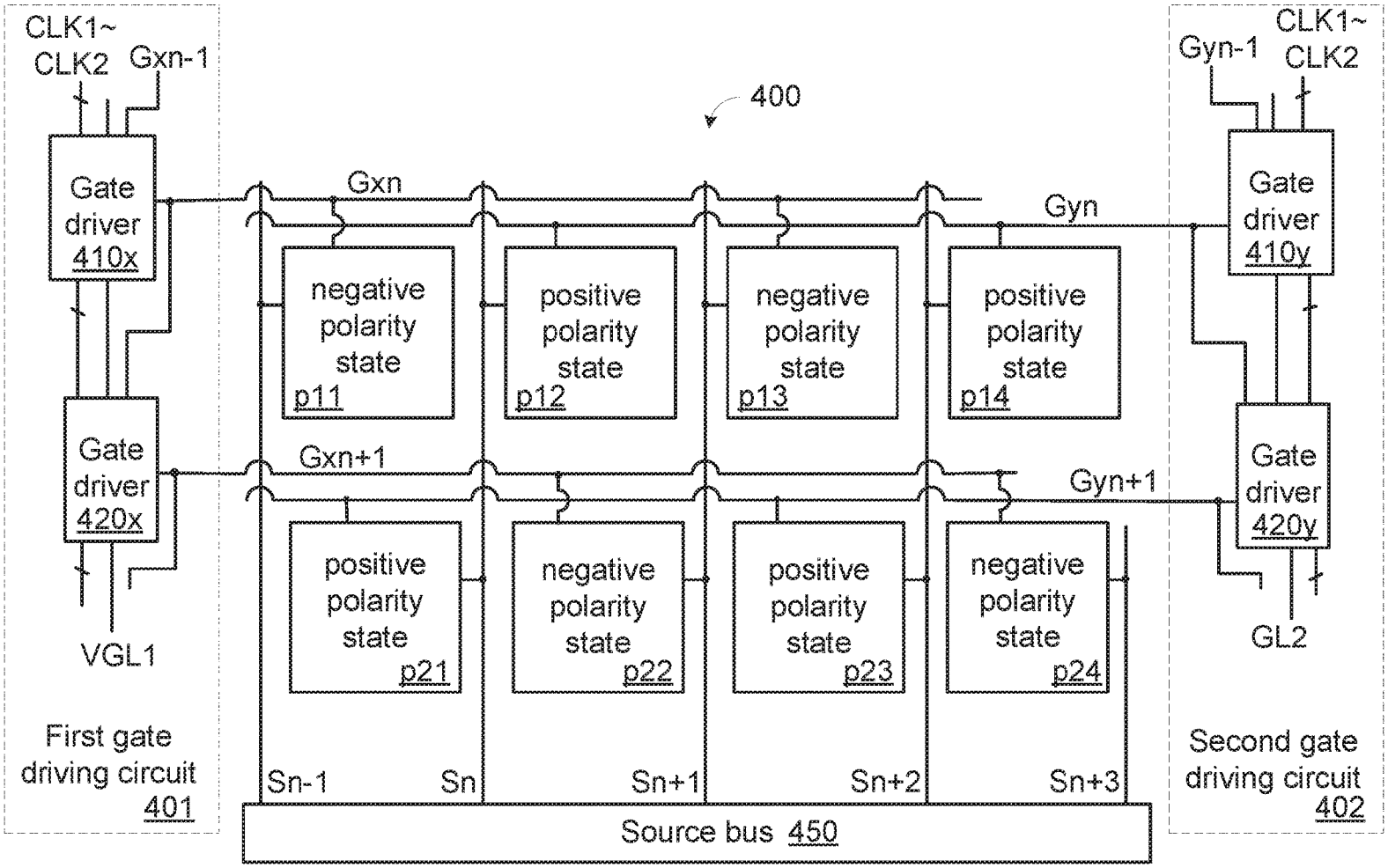
FIGS. 4B and 4C schematically illustrate the operation of the display panel according to the second embodiment of the present disclosure.

The operation of the display panel according to the second embodiment will be described with reference to FIGS. 4B and 4C. FIG. 4B schematically illustrates the operation of the display panel according to the second embodiment when a first frame is displayed. The video signals Sn−1, Sn+1 and Sn+3 have a first polarity (e.g., a negative polarity). The video signals Sn and Sn+2 have a second polarity (e.g., a positive polarity). The first gate driving circuit 401 receives a first low gate voltage VGL1, a clock signal CLK1 and a clock signal CLK2. The second gate driving circuit 402 receives a second low gate voltage VGL2, the clock signal CLK1 and the clock signal CLK2. The clock signal CLK2 has the waveform of FIG. 2B or the waveform of FIG. 2C.

When the gate pulse signal Gxn from the gate driver 410*x* and the gate pulse signal Gyn from the gate driver 410*y* are simultaneously activated, the pixel elements p11~p14 are simultaneously turned on. Since the pixel elements p11 and p13 receive the video signals Sn−1 and Sn+1 having the first polarity, the pixel elements p11 and p13 are in a negative polarity state. Since the pixel elements p12 and p14 receive the video signals Sn and Sn+2 having the second polarity, the pixel elements p12 and p14 are in a positive polarity state. Then, the pixel elements p11 and p13 are turned off in response to the first low gate voltage VGL1 of the gate pulse signal Gxn from the gate driver 410*x*, and the pixel elements p12 and p14 are turned off in response to the second low gate voltage VGL2 of the gate pulse signal Gyn from the gate driver 410*y*.

The gate pulse signals Gxn+1 and Gyn+1 are simultaneously activated by the gate drivers 420*x* and 420*y* according to the gate pulse signals Gxn and Gyn. When the gate pulse signal Gxn+1 and the gate pulse signal Gyn+1 are simultaneously activated, the pixel elements p21~p24 are simultaneously turned on. Since the pixel elements p22 and p24 receive the video signals Sn+1 and Sn+3 having the first polarity, the pixel elements p22 and p24 are in the negative polarity state. Since the pixel elements p21 and p23 receive the video signals Sn and Sn+2 having the second polarity, the pixel elements p21 and p23 are in the positive polarity state. Then, the pixel elements p21 and p23 are turned off in response to the first low gate voltage VGL1 of the gate pulse signal Gyn+1 from the gate driver 420*y*, and the pixel elements p22 and p24 are turned off in response to the second low gate voltage VGL2 of the gate pulse signal Gxn+1 from the gate driver 420*x*.

Figure 4C:
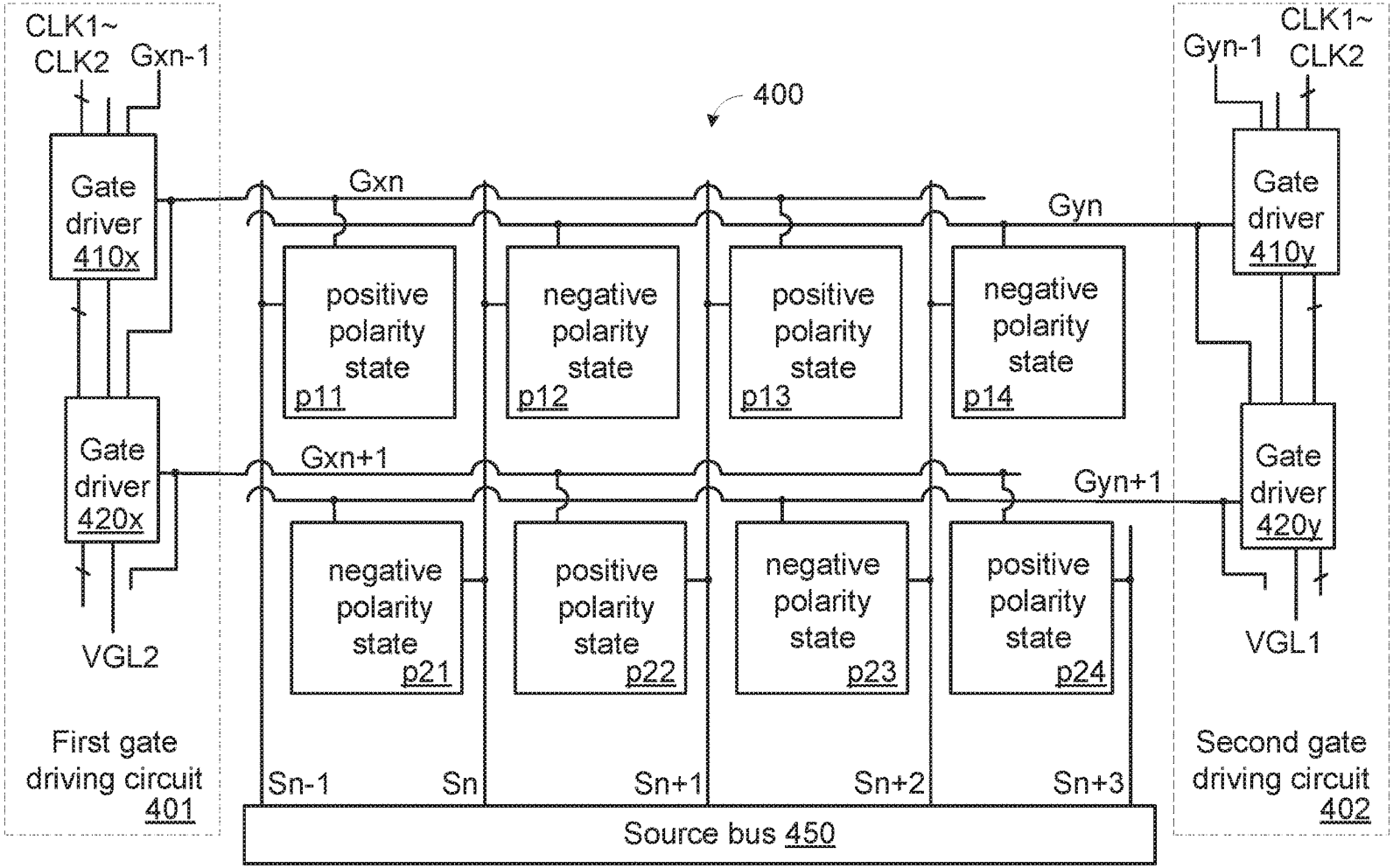

FIG. 4C schematically illustrates the operation of the display panel according to the second embodiment when a second frame is displayed. The video signals Sn−1, Sn+1 and Sn+3 have the second polarity (e.g., the positive polarity). The video signals Sn and Sn+2 have the first polarity (e.g., the negative polarity). The first gate driving circuit 401 receives the second low gate voltage VGL2, the clock signal CLK1 and the clock signal CLK2. The second gate driving circuit 402 receives the first low gate voltage VGL1, the clock signal CLK1 and the clock signal CLK2.

When the gate pulse signal Gxn from the gate driver 410*x* and the gate pulse signal Gyn from the gate driver 410*y* are simultaneously activated, the pixel elements p11~p14 are simultaneously turned on. Since the pixel elements p11 and p13 receive the video signals Sn−1 and Sn+1 having the second polarity, the pixel elements p11 and p13 are in the positive polarity state. Since the pixel elements p12 and p14 receive the video signals Sn and Sn+2 having the first polarity, the pixel elements p12 and p14 are in the negative polarity state. Then, the pixel elements p11 and p13 are turned off in response to the second low gate voltage VGL2 of the gate pulse signal Gxn from the gate driver 410*x*, and the pixel elements p12 and p14 are turned off in response to the first low gate voltage VGL1 of the gate pulse signal Gyn from the gate driver 410*y*.

The gate pulse signals Gxn+1 and Gyn+1 are simultaneously activated by the gate drivers 420*x* and 420*y* according to the gate pulse signals Gxn and Gyn. When the gate pulse signal Gxn+1 and the gate pulse signal Gyn+1 are simultaneously activated, the pixel elements p21~p24 are simultaneously turned on. Since the pixel elements p22 and p24 receive the video signals Sn+1 and Sn+3 having the second polarity, the pixel elements p22 and p24 are in the positive polarity state. Since the pixel elements p21 and p23 receive the video signals Sn and Sn+2 having the first polarity, the pixel elements p21 and p23 are in the negative polarity state. Then, the pixel elements p21 and p23 are turned off in response to the second low gate voltage VGL2 of the gate pulse signal Gyn+1 from the gate driver 420*y*, and the pixel elements p22 and p24 are turned off in response to the first low gate voltage VGL1 of the gate pulse signal Gxn+1 from the gate driver 420*x*.

Figure 5A:
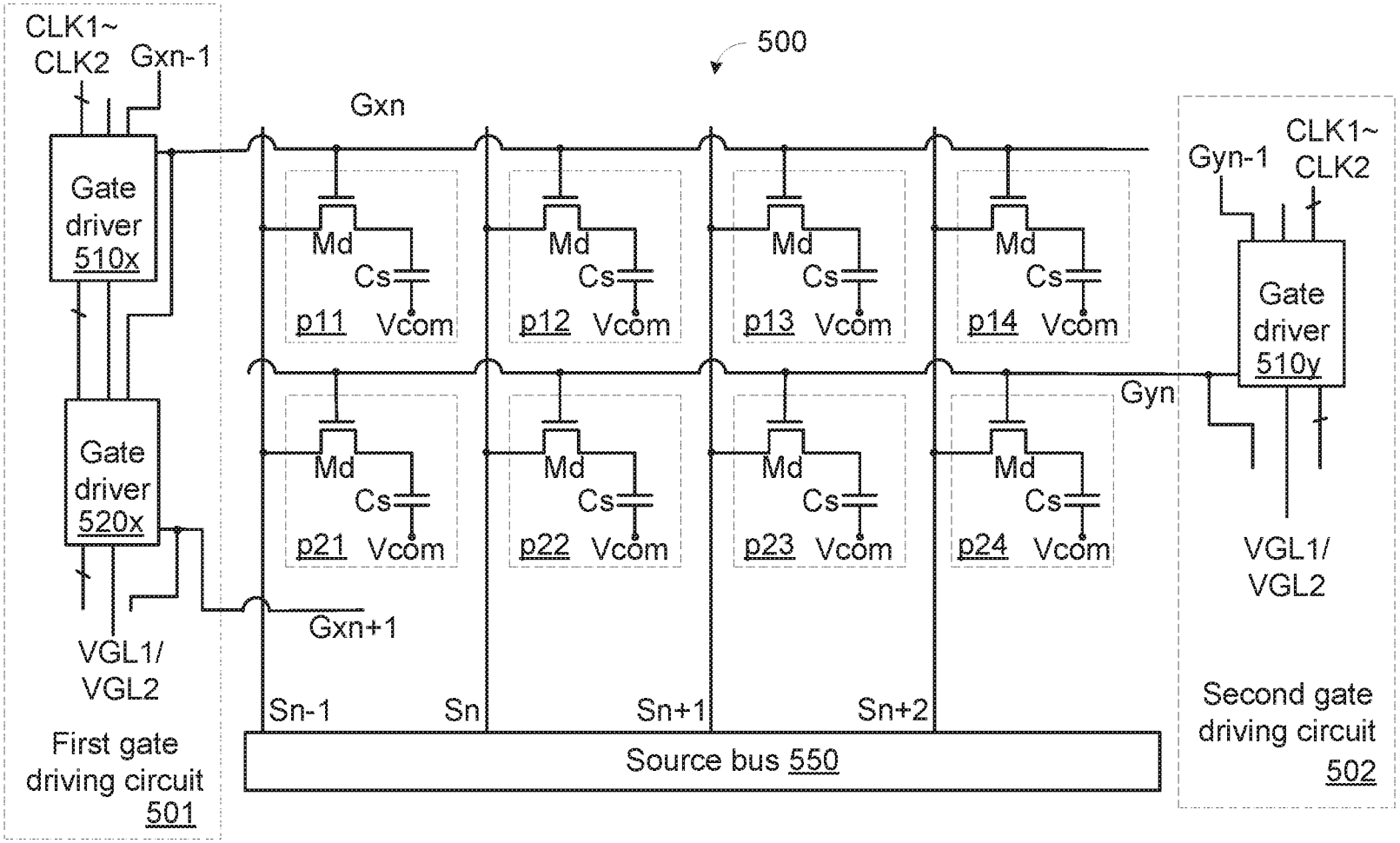
FIG. 5A is a schematic circuit diagram illustrating a display panel according to a third embodiment of the present disclosure.

FIG. 5A is a schematic circuit diagram illustrating a display panel according to a third embodiment of the present disclosure. As shown in FIG. 5A, the display panel 500 comprises a first gate driving circuit 501, a second gate driving circuit 502, a source bus 550 and plural pixel elements p11~p24. The plural pixel elements p11~p24 are arranged in a 2×4 pixel array. It is noted that the number of the pixel elements and the arrangement of the pixel array are not restricted. In this embodiment, the display panel 500 is operated in line inversion In the embodiment, the first gate driving circuit 501 and the second gate driving circuit 502 are disposed at two opposite sides of the display panel 500. In other embodiment, the first gate driving circuit 501 and the second gate driving circuit 502 could be disposed at the same side of the display panel 500.

The first gate driving circuit 501 comprises plural serially-connected gate drives. For clarification, only two gate drivers 510*x* and 520*x* of the first gate driving circuit 501 are shown. The second gate driving circuit 502 comprises plural serially-connected gate drives. For clarification, only one gate driver 510*y* of the second gate driving circuit 502 is shown. The pixel elements p11~p14 in the first row are connected to the gate driver 510*x* of the first gate driving circuit 501. The pixel elements p21~p24 in the second row are connected to the gate driver 510*y* of the second gate driving circuit 502. The source bus 550 comprises plural source lines, and the plural source lines are connected to the corresponding columns of pixel elements.

As shown in FIG. 5A, the source bus 550 comprises four source lines. The pixel elements p11 and p21 are connected to the first source line for receiving a video signal Sn−1. The pixel elements p12 and p22 are connected to the second source line for receiving a video signal Sn. The pixel elements p13 and p23 are connected to the third source line for receiving a video signal Sn+1. The pixel elements p14 and p24 are connected to the fourth source line for receiving a video signal Sn+2.

Figure 5B:
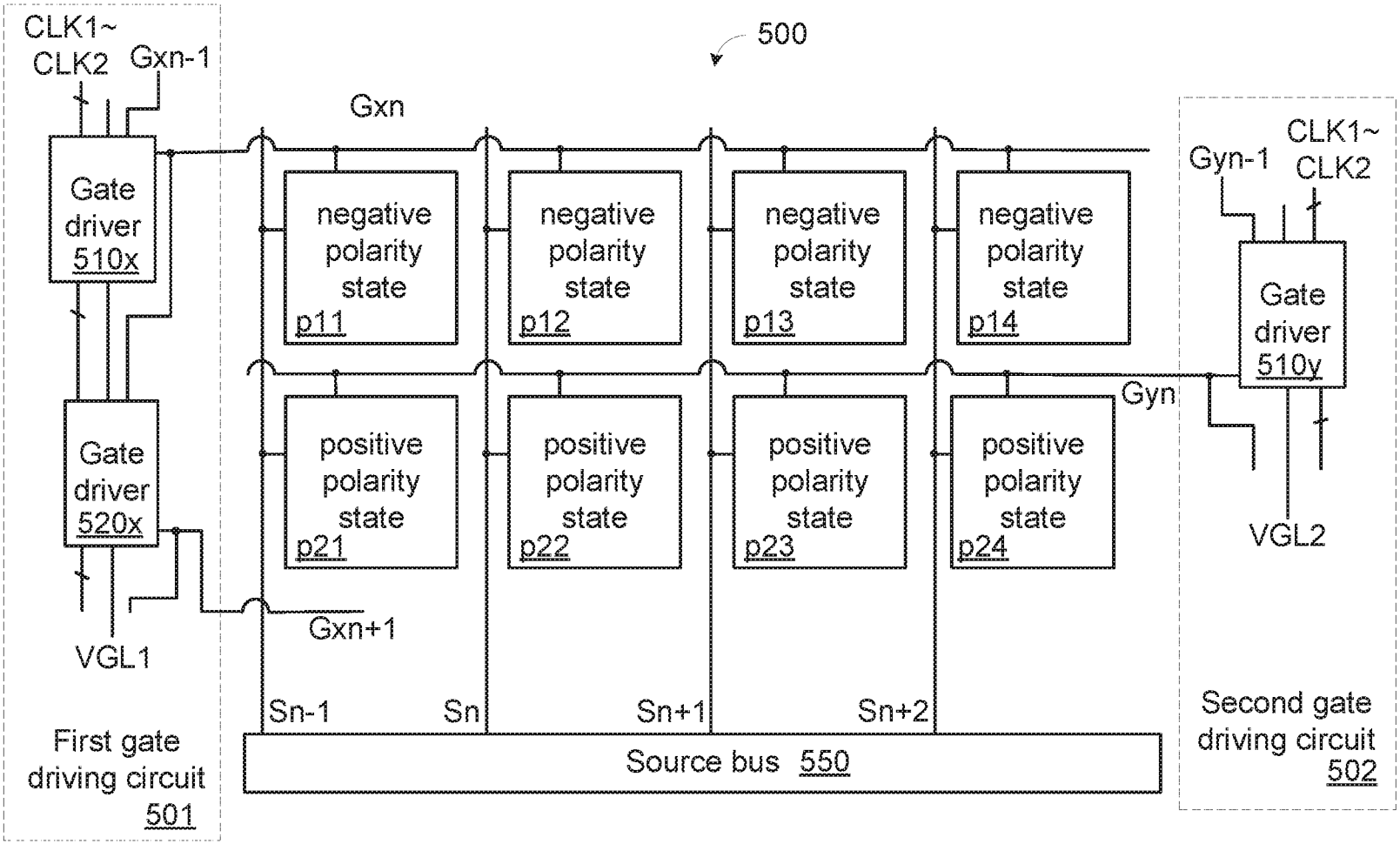
FIGS. 5B and 5C schematically illustrate the operation of the display panel according to the third embodiment of the present disclosure.

The operation of the display panel according to the third embodiment will be described with reference to FIGS. 5B and 5C. FIG. 5B schematically illustrates the operation of the display panel according to the third embodiment when a first frame is displayed. The video signals Sn−1~Sn+2 have a first polarity (e.g., a negative polarity) when a first row of the first frame is displayed on the display panel 500. The video signals Sn−1~Sn+2 have a second polarity (e.g., a positive polarity) when a second row of the first frame is displayed on the display panel 500. The first gate driving circuit 501 receives a first low gate voltage VGL1, a clock signal CLK1 and a clock signal CLK2. The second gate driving circuit 502 receives a second low gate voltage VGL2, the clock signal CLK1 and the clock signal CLK2. The clock signal CLK2 has the waveform of FIG. 2B or the waveform of FIG. 2C.

When the gate pulse signal Gxn from the gate driver 510*x* is activated, the pixel elements p11~p14 are simultaneously turned on. Since the pixel elements p11~p14 receive the video signals Sn−1~Sn+2 having the first polarity, the pixel elements p11~p14 are in a negative polarity state. Then, the pixel elements p11~p14 are turned off in response to the first low gate voltage VGL1 of the gate pulse signal Gxn from the gate driver 510*x*.

When the gate pulse signal Gyn from the gate driver 510*y* is activated, the pixel elements p21 p24 are simultaneously turned on. Since the pixel elements p21~p24 receive the video signals Sn−1~Sn+2 having the second polarity, the pixel elements p21~p24 are in a positive polarity state. Then, the pixel elements p21~p24 are turned off in response to the second low gate voltage VGL2 of the gate pulse signal Gyn from the gate driver 510*y*.

Figure 5C:
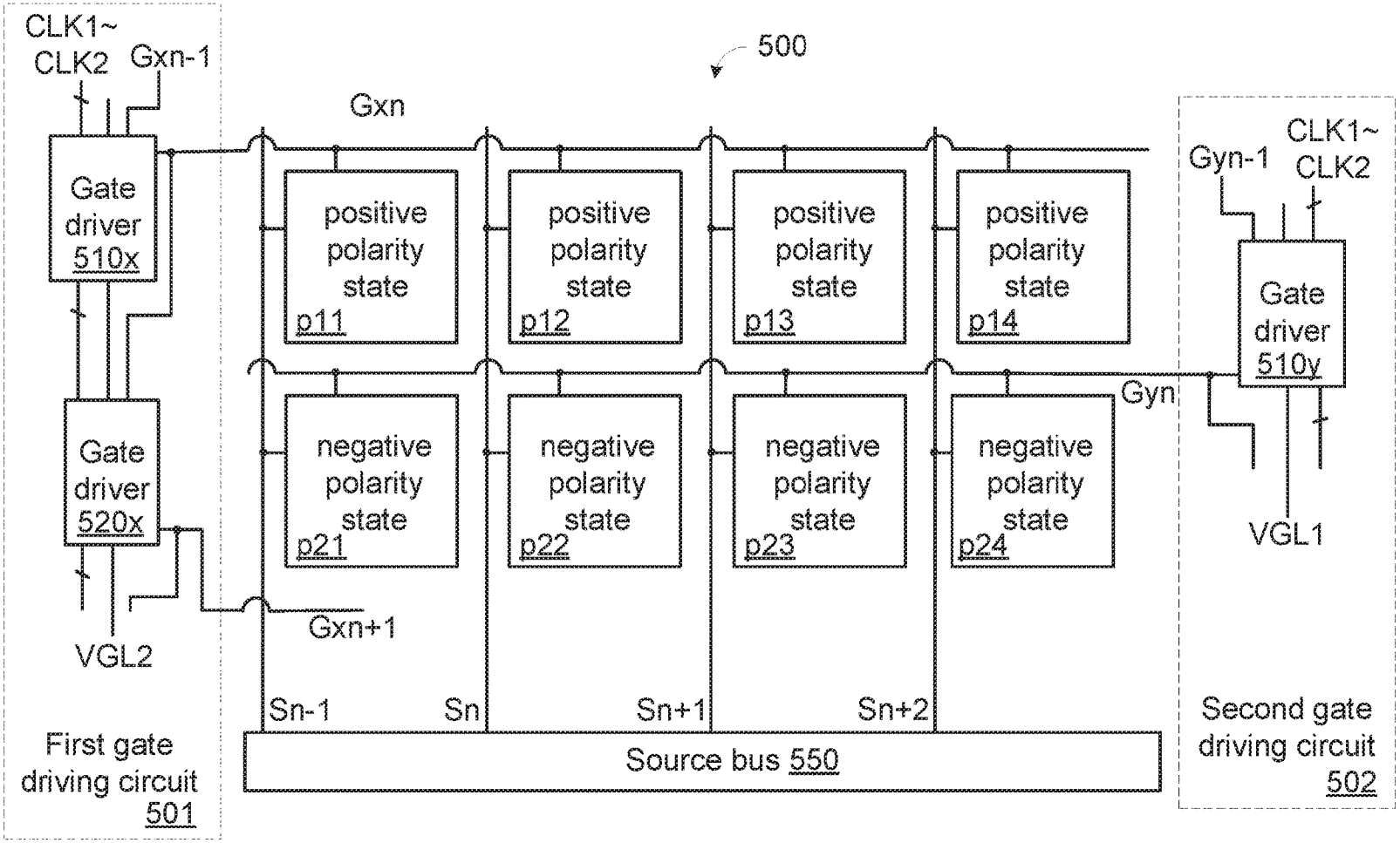

FIG. 5C schematically illustrates the operation of the display panel according to the third embodiment when a second frame is displayed. The video signals Sn−1~Sn+2 have the second polarity (e.g., the positive polarity) when a first row of the second frame is displayed on the display panel 500. The video signals Sn−1~Sn+2 have the first polarity (e.g., the negative polarity) when a second row of the second frame is displayed on the display panel 500. The first gate driving circuit 501 receives the second low gate voltage VGL2, the clock signal CLK1 and the clock signal CLK2. The second gate driving circuit 502 receives the first low gate voltage VGL1, the clock signal CLK1 and the clock signal CLK2.

When the gate pulse signal Gxn from the gate driver 510*x* is activated, the pixel elements p11~p14 are simultaneously turned on. Since the pixel elements p11~p14 receive the video signals Sn−1~Sn+2 having the second polarity, the pixel elements p11~p14 are in the positive polarity state. Then, the pixel elements p11~p14 are turned off in response to the second low gate voltage VGL2 of the gate pulse signal Gxn from the gate driver 510*x*.

When the gate pulse signal Gyn from the gate driver 510*y* is activated, the pixel elements p21~p24 are simultaneously turned on. Since the pixel elements p21~p24 receive the video signals Sn−1~Sn+2 having the first polarity, the pixel elements p21~p24 are in the negative polarity state. Then, the pixel elements p21~p24 are turned off in response to the first low gate voltage VGL1 of the gate pulse signal Gyn from the gate driver 510*y*.

Figure 6A:
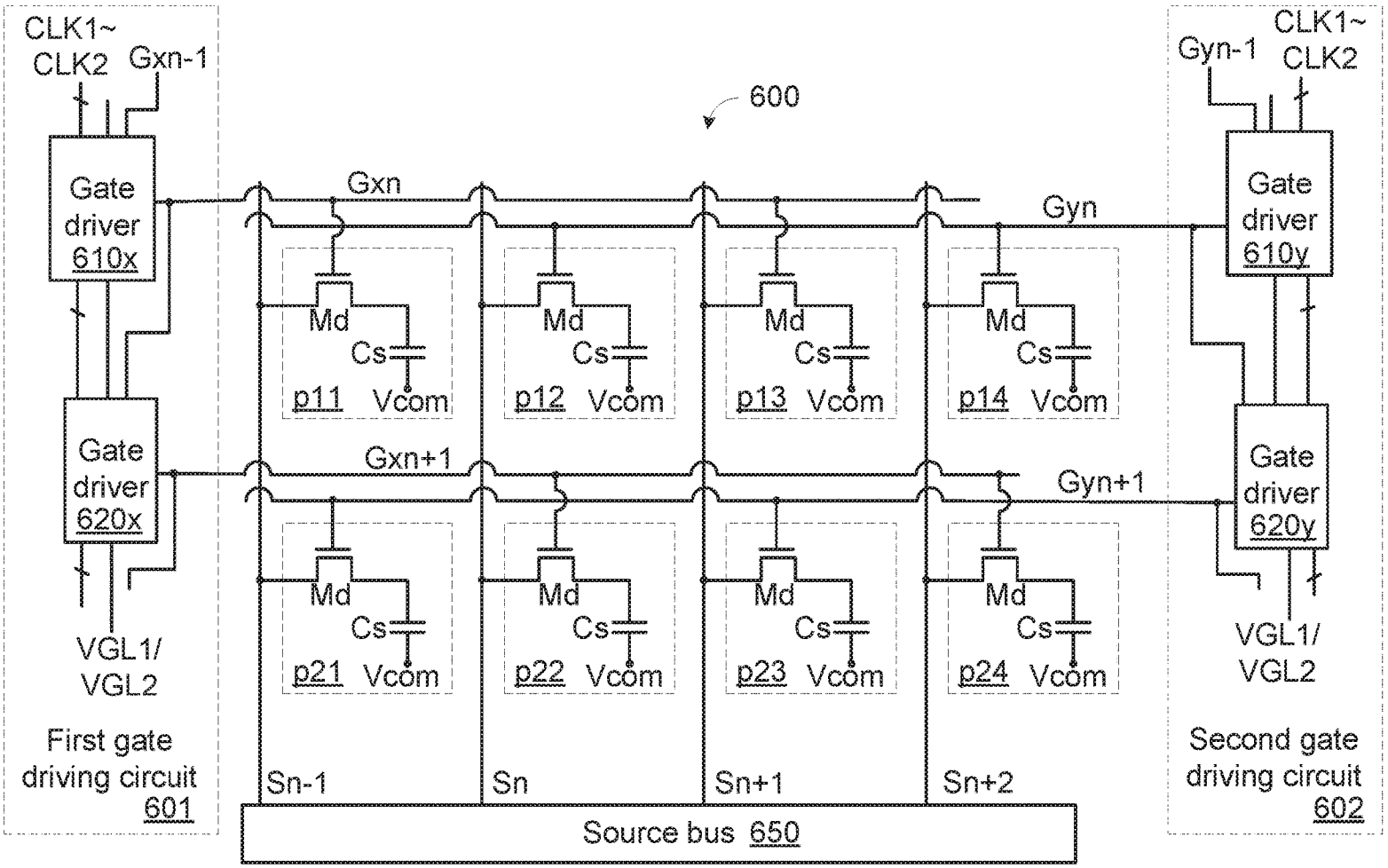
FIG. 6A is a schematic circuit diagram illustrating a display panel according to a fourth embodiment of he present disclosure.

FIG. 6A is a schematic circuit diagram illustrating a display panel according to a fourth embodiment of the present disclosure. As shown in FIG. 6A, the display panel 600 comprises a first gate driving circuit 601, a second gate driving circuit 602, a source bus 650 and plural pixel elements p11~p24. The plural pixel elements p11~p24 are arranged in a 2×4 pixel array. It is noted that the number of the pixel elements and the arrangement of the pixel array are not restricted. In this embodiment, the display panel 600 is operated in dot inversion. In the embodiment, the first gate driving circuit 601 and the second gate driving circuit 602 are disposed at two opposite sides of the display panel 600. In other embodiment, the first gate driving circuit 601 and the second gate driving circuit 602 could be disposed at the same side of the display panel 600.

The first gate driving circuit 601 comprises plural serially-connected gate drives. For clarification, only two gate drivers 610*x* and 620*x* of the first gate driving circuit 601 are shown. The second gate driving circuit 602 comprises plural serially-connected gate drives. For clarification, only two gate drivers 610*y* and 620*y* of the second gate driving circuit 602 are shown. Moreover, a first portion of the pixel elements in the same row are connected to the first gate driving circuit 601 and a second portion of the pixel elements in the same row are connected to the second gate driving circuit 602.

The connecting relations of the pixels p11~p14 in the first row will be described as follows. The odd-numbered pixel elements p11 and p13 are connected to the gate driver 610*x* of the first gate driving circuit 601. The even-numbered pixel elements p12 and p14 are connected to the gate driver 610*y* of the second gate driving circuit 602. The gate pulse signal Gxn from the gate driver 610*x* and the gate pulse signal Gyn from the gate driver 610*y* are simultaneously activated.

The connecting relations of the pixels p21~p24 in the second row will be described as follows. The odd-numbered pixel elements p21 and p23 are connected to the gate driver 620*y* of the second gate driving circuit 602. The even-numbered pixel elements p22 and p24 are connected to the gate driver 620*x* of the first gate driving circuit 601. The gate pulse signal Gxn+1 from the gate driver 620*x* and the gate pulse signal Gyn+1 from the gate driver 620*y* are simultaneously activated.

The source bus 650 comprises plural source lines, and the plural source lines are connected to the corresponding columns of pixel elements. As shown in FIG. 6A, the source bus 650 comprises four source lines. The pixel elements p11 and p21 are connected to the first source line for receiving a video signal Sn−1. The pixel elements p12 and p22 are connected to the second source line for receiving a video signal Sn. The pixel elements p13 and p23 are connected to the third source line for receiving a video signal Sn+1. The pixel elements p14 and p24 are connected to the fourth source line for receiving a video signal Sn+2.

Figure 6B:
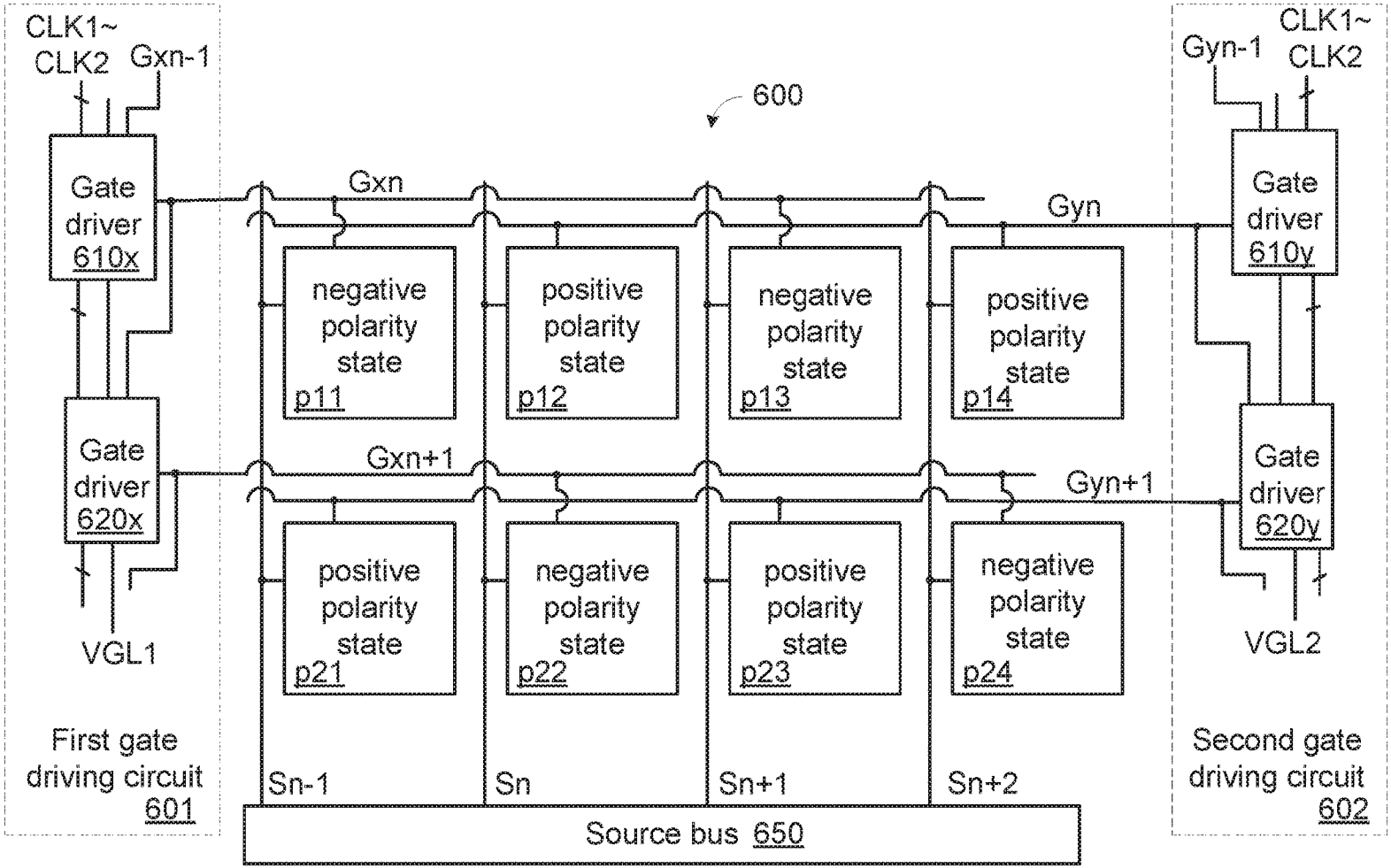
FIGS. 6B and 6C schematically illustrate the operation of the display panel according to the fourth embodiment of the present disclosure.

The operation of the display panel according to the first embodiment will be described with reference to FIGS. 6B and 6C. FIG. 6B schematically illustrates the operation of the display panel according to the fourth embodiment when a first frame is displayed. When a first row of a first frame is displayed on the display panel 600, the video signals Sn−1 and Sn+1 have a first polarity (e.g., a negative polarity) and the video signals Sn and Sn+2 have a second polarity (e.g., a positive polarity). When a second row of the first frame is displayed on the display panel 600, the video signals Sn−1 and Sn+1 have the second polarity (e.g., the positive polarity) and the video signals Sn and Sn+2 have the first polarity (e.g., the negative polarity). The first gate driving circuit 601 receives a first low gate voltage VGL1, a clock signal CLK1 and a clock signal CLK2. The second gate driving circuit 602 receives a second low gate voltage VGL2, the dock signal CLK1 and the clock signal CLK2. The clock signal CLK2 has the waveform of FIG. 2B or the waveform of FIG. 2C.

When the gate pulse signal Gxn from the gate driver 610*x* and the gate pulse signal Gyn from the gate driver 610*y* are simultaneously activated, the pixel elements p11~p14 are simultaneously turned on. Since the pixel elements p11 and p13 receive the video signals Sn−1 and Sn+1 having the first polarity, the pixel elements p11 and p13 are in a negative polarity state. Since the pixel elements p12 and p14 receive the video signals Sn and Sn+2 having the second polarity, the pixel elements p12 and p14 are in a positive polarity state. Then, the pixel elements p11 and p13 are turned off in response to the first low gate voltage VGL1 of the gate pulse signal Gxn from the gate driver 610*x*, and the pixel elements p12 and p14 are turned off in response to the second low gate voltage VGL2 of the gate pulse signal Gyn from the gate driver 610*y*.

The gate pulse signals Gxn+1 and Gyn+1 are simultaneously activated by the gate drivers 620*x* and 620*y* according to the gate pulse signals Gxn and Gyn. When the gate pulse signal Gxn+1 and the gate pulse signal Gyn+1 are simultaneously activated, the pixel elements p21~p24 are simultaneously turned on. Since the pixel elements p21 and p23 receive the video signals Sn−1 and Sn+1 having the second polarity, the pixel elements p21 and p23 are in the positive polarity state. Since the pixel elements p22 and p24 receive the video signals Sn and Sn+2 having the second polarity, the pixel elements p22 and p24 are in the negative polarity state. Then, the pixel elements p22 and p24 are turned off in response to the first low gate voltage VGL1 of the gate pulse signal Gxn+1 from the gate driver 620*x*, and the pixel elements p21 and p23 are turned off in response to the second low gate voltage VGL2 of the gate pulse signal Gyn+1 from the gate driver 620*y*.

Figure 6C:
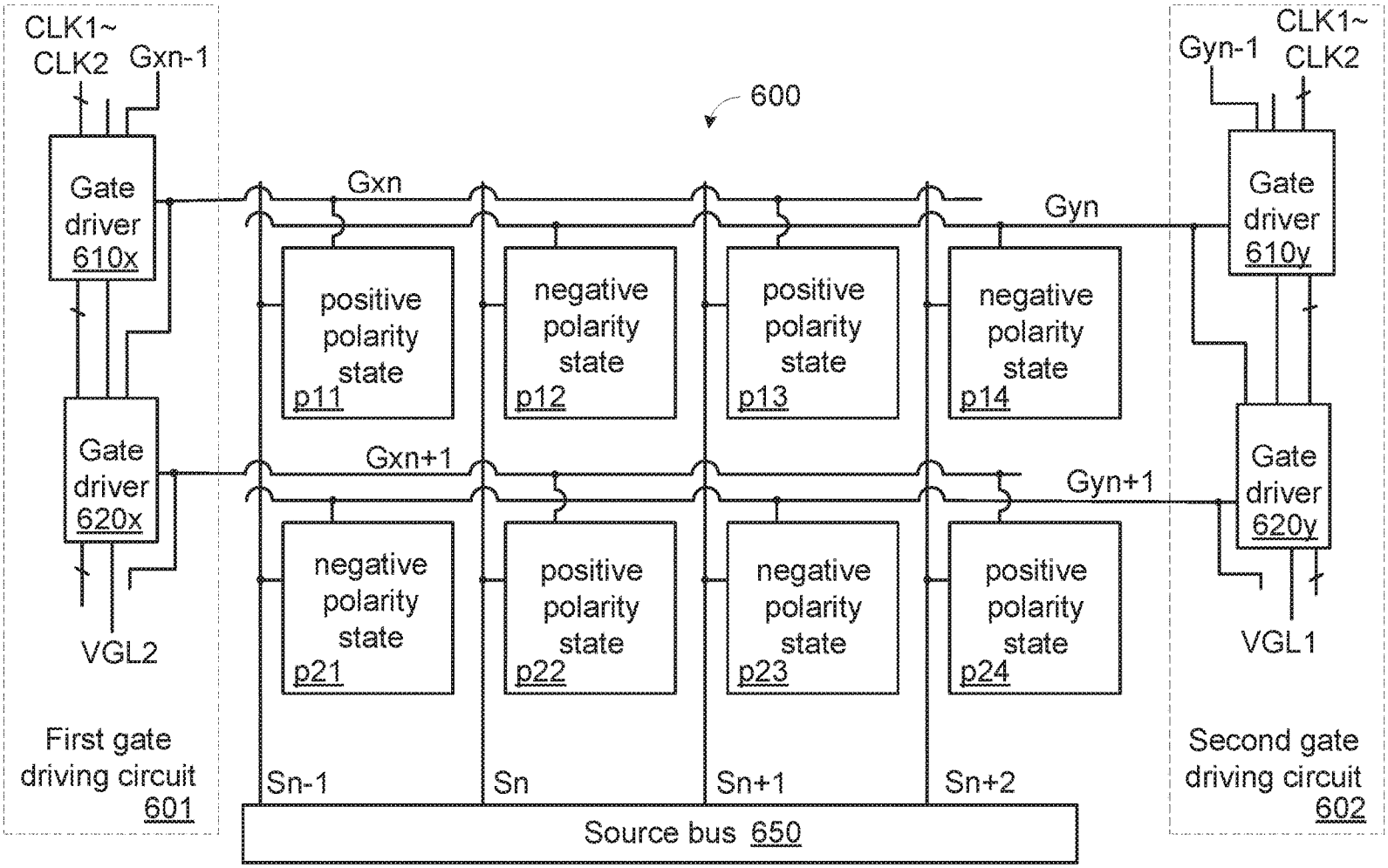

FIG. 6C schematically illustrates the operation of the display panel according to the fourth embodiment when a second frame is displayed. When a first row of a second frame is displayed on the display panel 600, the video signals Sn−1 and Sn+1 have the second polarity (e.g., the positive polarity) and the video signals Sn and Sn+2 have the first polarity (e.g., the negative polarity). When a second row of the second frame is displayed on the display panel 600, the video signals Sn−1 and Sn+1 have the first polarity (e.g., the negative polarity) and the video signals Sn and Sn+2 have the second polarity (e.g., the positive polarity). The first gate driving circuit 601 receives the second low gate voltage VGL2, the clock signal CLK1 and the clock signal CLK2. The second gate driving circuit 602 receives the first low gate voltage VGL1, the clock signal CLK1 and the clock signal CLK2.

When the gate pulse signal Gxn from the gate driver 610*x* and the gate pulse signal Gyn from the gate driver 610*y* are simultaneously activated, the pixel elements p11~p14 are simultaneously turned on. Since the pixel elements p11 and p13 receive the video signals Sn−1 and Sn+1 having the second polarity, the pixel elements p11 and p13 are in the positive polarity state. Since the pixel elements p12 and p14 receive the video signals Sn and Sn+2 having the first polarity, the pixel elements p12 and p14 are in the negative polarity state. Then, the pixel elements p11 and p13 are turned off in response to the second low gate voltage VGL2 of the gate pulse signal Gxn from the gate driver 610*x*, and the pixel elements p12 and p14 are turned off in response to the first low gate voltage VGL1 of the gate pulse signal Gyn from the gate driver 610*y*.

The gate pulse signals Gxn+1 and Gyn+1 are simultaneously activated by the gate drivers 620*x* and 620*y* according to the gate pulse signals Gxn and Gyn. When the gate pulse signal Gxn+1 and the gate pulse signal Gyn+1 are simultaneously activated, the pixel elements p21~p24 are simultaneously turned on. Since the pixel elements p21 and p23 receive the video signals Sn−1 and Sn+1 having the first polarity, the pixel elements p21 and p23 are in the negative polarity state. Since the pixel elements p22 and p24 receive the video signals Sn and Sn+2 having the second polarity, the pixel elements p22 and p24 are in the positive polarity state. Then, the pixel elements p22 and p24 are turned off in response to the second low gate voltage VGL2 of the gate pulse signal Gxn+1 from the gate driver 620*x*, and the pixel elements p21 and p23 are turned off in response to the first low gate voltage VGL1 of the gate pulse signal Gyn+1 from the gate driver 620*y*.

Figure 7:
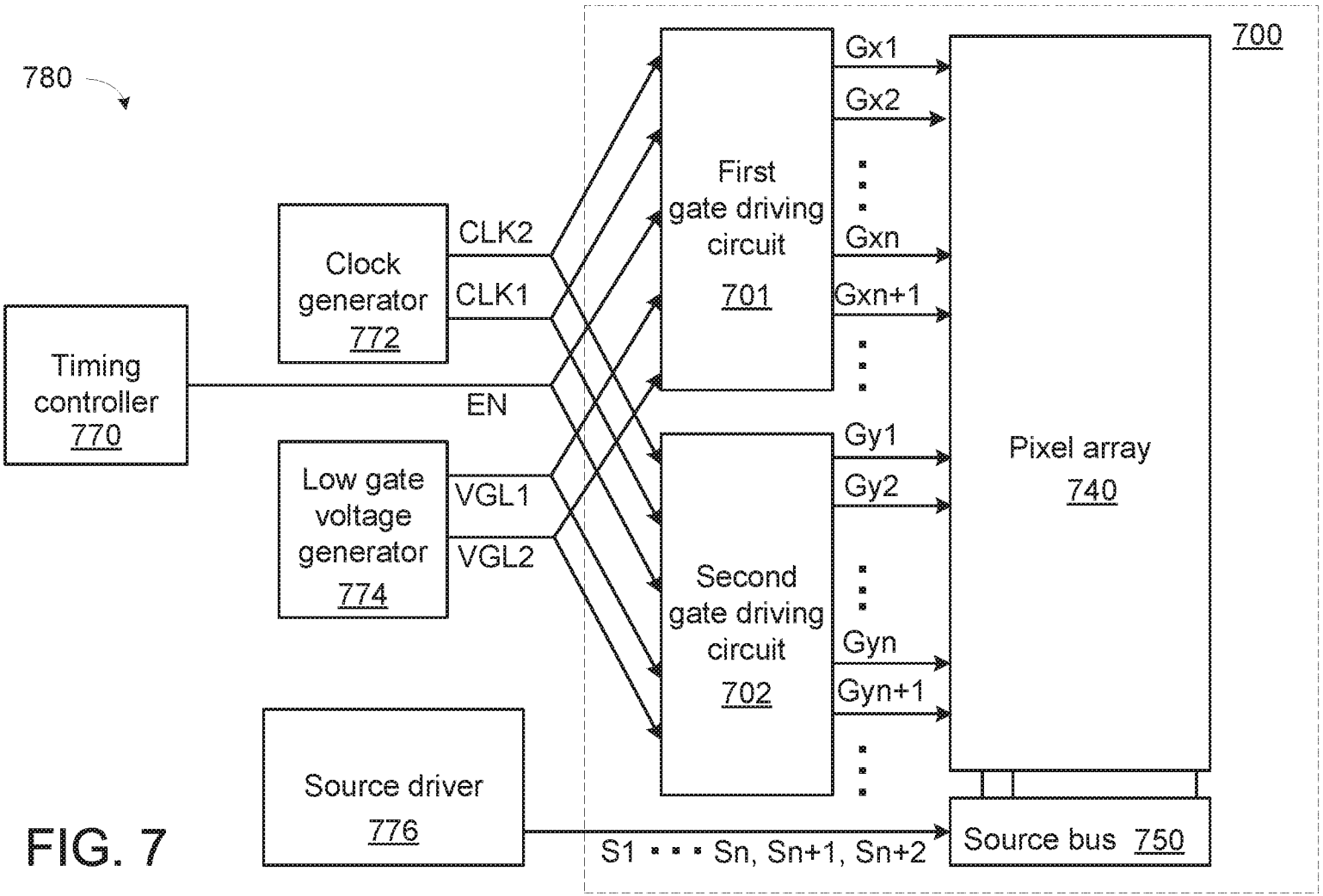
FIG. 7 schematically illustrates the architecture of a display device according to an embodiment of the present disclosure.

FIG. 7 schematically illustrates the architecture of a display device according to an embodiment of the present disclosure. As shown in FIG. 7, the display device 780 comprises a timing controller 770, a clock generator 772, a low gate voltage generator 774, a source driver 776 and a display panel 700. The timing controller 770, the clock generator 772, the low gate voltage generator 774 and the source driver 776 are parts of driving control unit. The display panel 700 has the architecture of the display panel according to any of the above embodiments. The display panel 700 comprises a first gate driving circuit 701, a second gate driving circuit 702, a pixel array 740 and a source bus 750, The clock generator 772 generates the clock signals CLK1 and CLK2 to the first gate driving circuit 701 and the second gate driving circuit 702. The low gate voltage generator 774 generates the first low gate voltage VGL1 and the second low gate voltage VGL2 to the first gate driving circuit 701 and the second gate driving circuit 702. The source driver 776 generates a video signal set S1~Sn+2 to the source bus 750. Consequently, the video signal set S1~Sn+2 can be transmitted from the source bus 750 to the pixel array 740.

The timing controller 770 issues an enable pulse signal EN to a start gate driver of the first gate driving circuit 701 and a start gate driver of the second gate driving circuit 702. The start gate driver of the first gate driving circuit 701 and the start gate driver of the second gate driving circuit 702 generate the gate pulse signals Gx1 and Gy1 in response to the enable pulse signal EN. Subsequently, the first gate driving circuit 701 sequentially generates the gate pulse signal set Gx2~Gxn+1 to the pixel array 740, and the second gate driving circuit 702 sequentially generates the gate pulse signal set Gy2~Gyn+1 to the pixel array 740.

Moreover, the first gate driving circuit 701 is connected to a first portion of the pixel elements of the pixel array 740, and the second gate driving circuit 702 is connected to a second portion of the pixel elements of the pixel array 740. When the first portion of the pixel elements are in the negative polarity state, the second portion of the pixel elements are in the positive polarity state. When the first portion of the pixel elements are in the positive polarity state, the second portion of the pixel elements are in the negative polarity state.

When the first portion of the pixel elements are in the negative polarity state, the first portion of the pixel elements are turned off in response to the first low gate voltage VGL1 of the gate pulse signal set Gx1~Gxn+1 from the first gate driving circuit 701. When the first portion of the pixel elements are in the positive polarity state, the first portion of the pixel elements are turned off in response to the second low gate voltage VGL2 of the gate pulse signal set Gx1~Gxn+1 from the first gate driving circuit 701.

When the second portion of the pixel elements are in the negative polarity state, the second portion of the pixel elements are turned off in response to the first low gate voltage VGL1 of the gate pulse signal set Gy1~Gyn+1 from the second gate driving circuit 702. When the second portion of the pixel elements are in the positive polarity state, the second portion of the pixel elements are turned off in response to the second low gate voltage VGL2 of the gate pulse signal set Gy1~Gyn+1 from the second gate driving circuit 702.

From the above descriptions, the present disclosure provides a display panel and a display device. In the above embodiments, the pixel elements are turned on according to the high gate voltage VGH of the gate pulse signal provided by the gate driver. Moreover, the pixel elements are turned off according to different low gate voltages provided by the gate driver in different states of the pixel elements. For example, when the pixel element is in a negative polarity state, the gate driver provides a first low gate voltage VGL1 to turn off the pixel element. When the pixel element is in a positive polarity state, the gate driver provides a second low gate voltage VGL2 to turn off the pixel element.

Since the gate driver provides different low gate voltages according to the state of the pixel element, the gate-source voltage of the switching transistor of the pixel element is decreased. Consequently, the off current of the pixel element can be effectively decreased. Since the off current of the pixel element is effectively decreased, the image quality is not deteriorated when the static image is displayed on the display panel at a reduced frame rate. For example, when the frame rate of displaying the static image on the display panel is decreased from 60 frames per second to 10 frames per second, the image quality is still satisfied. Consequently, the power consumption of the display panel is reduced.

The semiconductor layer of transistor in display panel of the present disclosure is low temperature poly-silicon (LTPS), amorphous silicon or metal oxide semiconductor (IGZO). The gate driver used in the gate driving circuit is not restricted to the gate driver of FIG. 2A. It is noted that numerous modifications and alterations may be made while retaining the teachings of the disclosure. Any other comparable gate driver can be used in the gate driving circuit of the display panel and the display device of the present disclosure.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A display panel, comprising:

a first gate driving circuit generating a first gate pulse signal;

a second gate driving circuit generating a second gate pulse signal, wherein the first gate pulse signal and the second gate pulse signal are simultaneously activated; and a first pixel element row comprising a first pixel element arid a second pixel element, wherein the first pixel element receives the first gate pulse signal, and the second pixel element receives the second gate pulse signal, wherein while the first pixel element is in a negative polarity state, the second pixel element is in a positive polarity state, the first pixel element is turned off in response to a first low gate voltage of the first gate pulse signal, and the second pixel element is turned off in response to a second low gate voltage of the second gate pulse signal, wherein while the first pixel element is in the positive polarity state, the second pixel element is in the negative polarity state, the first pixel element is turned off in response to a second low gate voltage of the first gate pulse signal, and the second pixel element is turned off in response to a first low gate voltage of the second gate pulse signal, wherein the first low gate voltage of the first gate pulse signal is less than the second low gate voltage of the first gate pulse signal, and the first low gate voltage of the second gate pulse signal is less than the second low gate voltage of the second gate pulse signal.

2. The display panel as claimed in claim 1, wherein the first gate driving circuit comprises a first gate driver that receives a first clock signal, a second clock signal and a first previous gate pulse signal, and the first gate driver generates the first gate pulse signal, wherein the second gate driving circuit comprises a second gate driver that receives the first clock signal, the second clock signal and a second previous gate pulse signal, and the second gate driver generates the second gate pulse signal.

3. The display panel claimed in claim 2, wherein the first gate driver comprises:

a latch circuit receiving the first clock signal and the first previous gate pulse signal, wherein the latch circuit is in a set state or a reset state according to the first clock signal and the first previous gate pulse signal; and an output circuit receiving the second clock signal and generating the first gate pulse signal, wherein the first gate pulse signal from the output circuit includes the second clock signal when the latch circuit is in the set state, and the first gate pulse signal from the output circuit includes the first low gate voltage or the second low gate voltage when the latch circuit is in the reset state.

4. The display panel as claimed in claim 2, wherein the first gate driving circuit further comprises a third gate driver that receives the first clock signal and generates a third gate pulse signal, wherein the second gate driving circuit further comprises a fourth gate driver that receives the first clock signal and generates a fourth gate pulse signal.

5. The display panel as claimed in claim 4, wherein the first pixel element receives the first gate pulse signal and a first video signal from a source bus, and the second pixel element receives the second gate pulse signal and a second video signal from the source bus.

6. The display panel as claimed in claim 5, wherein the display panel further comprises a second pixel element row with a third pixel element and a fourth pixel element, wherein the third pixel element receives the third gate pulse signal and the first video signal from the source bus, and the fourth pixel element receives the fourth gate pulse signal and the second video signal from the source bus.

7. The display panel as claimed in claim 5, wherein the display panel further comprises a second pixel element row with a third pixel element and a fourth pixel element, wherein the third pixel element receives the third gate pulse signal and the second video signal from the source bus, and the fourth pixel element receives the fourth gate pulse signal and a third video signal from the source bus.

8. The display panel as claimed in claim 5, wherein the display panel further comprises a second pixel element row with a third pixel element and a fourth pixel element, wherein the third pixel element receives the fourth gate pulse signal and the first video signal from the source bus, and the fourth pixel element receives the third gate pulse signal and the second video signal from the source bus.

9. A display panel, comprising:

a first gate driving circuit generating a first gate pulse signal;

a second gate driving circuit generating a second gate pulse signal;

a first pixel element row receiving the first gate pulse signal; and a second pixel element row receiving the second gate pulse signal, wherein while plural pixel elements of the first pixel element row are in a negative polarity state, plural pixel elements of the second pixel element row are in a positive polarity state, the plural pixel elements of the first pixel element row are turned off in response to a first low gate voltage of the first gate pulse signal, and the plural pixel elements of the second pixel element row are turned off in response to a second low gate voltage of the second gate pulse signal, wherein while the plural pixel elements of the first pixel element row are in the positive polarity state, the plural pixel elements of the second pixel element row are in the negative polarity state, the plural pixel elements of the first pixel element row are turned off in response to a second low gate voltage of the first gate pulse signal, and the plural pixel elements of the second pixel element row are turned off in response to a first low gate voltage of the second gate pulse signal, wherein the first low gate voltage of the first gate pulse signal is less than the second low gate voltage of the first gate pulse signal, and the first low gate voltage of the second gate pulse signal is less than the second low gate voltage of the second gate pulse signal.

10. The display panel as claimed in claim 9, wherein the first gate driving circuit comprises a first gate driver that receives a first clock signal, a second clock signal and a first previous gate pulse signal, and the first gate driver generates the first gate pulse signal, wherein the second gate driving circuit comprises a second gate driver that receives the first clock signal, the second clock signal and a second previous gate pulse signal, and the second gate driver generates the second gate pulse signal.

11. The LCD panel as claimed in claim 10, wherein the first gate driver comprises:

a latch circuit receiving the first clock signal and the first previous gate pulse signal, wherein the latch circuit is in a set state or a reset state according to the first clock signal and the first previous gate pulse signal; and an output circuit receiving the second clock signal and generating the first gate pulse signal, wherein the first gate pulse signal from the output circuit contains the second pulse signal when the latch circuit is in the set state, and the first gate pulse signal from the output circuit contains the first low gate voltage or the second low gate voltage when the latch circuit is in the reset state.

12. A display device, comprising:

a driving control unit; and a display panel electrically connected to the driving control unit, wherein the display panel comprises:

a first gate driving circuit generating a first gate pulse signal;

a second gate driving circuit generating a second gate pulse signal;

wherein the first gate pulse signal and the second gate pulse signal are simultaneously activated; and a first pixel element row comprising a first pixel element and a second pixel element, wherein the first pixel element receives the first gate pulse signal, and the second pixel element receives the second gate pulse signal, wherein while the first pixel element is in a negative polarity state, the second pixel element is in a positive polarity state, the first pixel element is turned off in response to a first low gate voltage of the first gate pulse signal, and the second pixel element is turned off in response to a second low gate voltage of the second gate pulse signal, wherein while the first pixel element is in the positive polarity state, the second pixel element is in the negative polarity state, the first pixel element is turned off in response to a second low gate voltage of the first gate pulse signal, and the second pixel element is turned off in response to a first low gate voltage of the second gate pulse signal, wherein the first low gate voltage of the first gate pulse signal is less than the second low gate voltage of the first gate pulse signal, and the first low gate voltage of the second gate pulse signal is less than the second low gate voltage of the second gate pulse signal.

13. The display device as claimed in claim 12, wherein the first gate driving circuit comprises a first gate driver that receives a first clock signal, a second clock signal and a first previous gate pulse signal, and the first gate driver generates the first gate pulse signal, wherein the second gate driving circuit comprises a second gate driver that receives the first clock signal, the second clock signal and a second previous gate pulse signal, and the second gate driver generates the second gate pulse signal.

14. The display device as claimed in claim 13, wherein the first gate driver comprises:

a latch circuit receiving the first clock signal and the first previous gate pulse signal, wherein the latch circuit is in a set state or a reset state according to the first clock signal and the first previous gate pulse signal; and an output circuit receiving the second clock signal, the first low gate voltage and the second low gate voltage, and generating the first gate pulse signal, wherein the first gate pulse signal from the output circuit includes the second clock signal when the latch circuit is in the set state, and the first gate pulse signal from the output circuit includes the first low gate voltage of the first gate pulse signal or the second low gate voltage of the first gate pulse signal when the latch circuit is in the reset state.

15. The display device as claimed in claim 13, wherein the first gate driving circuit further comprises a third gate driver that receives the first clock signal and generates a third gate pulse signal, wherein the second gate driving circuit further comprises a fourth gate driver that receives the first clock signal, the second clock signal and the second gate pulse signal, and the fourth gate driver generates a fourth gate pulse signal.

16. The display device as claimed in claim 15, wherein the first pixel element receives the first gate pulse signal and a first video signal from a source bus, and the second pixel element receives the second gate pulse signal and a second video signal from the source bus.

17. The display device as claimed in claim 16, wherein the display panel further comprises a second pixel element row with a third pixel element and a fourth pixel element, wherein the third pixel element receives the third gate pulse signal and the first video signal from the source bus, and the fourth pixel element receives the fourth gate pulse signal and the second video signal from the source bus.

18. The display device as claimed in claim 16, wherein the display panel further comprises a second pixel element row with a third pixel element and a fourth pixel element, wherein the third pixel element receives the third gate pulse signal and the second video signal from the source bus, and the fourth pixel element receives the fourth gate pulse signal and a third video signal from the source bus.

19. The display device as claimed in claim 16, wherein the display panel further comprises a second pixel element row with a third pixel element and a fourth pixel element, wherein the third pixel element receives the fourth gate pulse signal and the first video signal from the source bus, and the fourth pixel element receives the third gate pulse signal and the second video signal from the source bus.

20. The display device as claimed in claim 12, wherein driving control unit comprises:

a clock generator generating the first clock signal and the second clock signal;

a low gate voltage generator generating the first low gate voltage of the first gate pulse signal, the first low gate voltage of the second gate pulse signal, the second low gate voltage of the first gate pulse signal, and the second low gate voltage of the second gate pulse signal;

a source driver generating the first video signal and the second video signal; and a timing controller generating a enable pulse signal.

* * * * *